US010065419B2

(12) United States Patent
Kira

(10) Patent No.: US 10,065,419 B2
(45) Date of Patent: Sep. 4, 2018

(54) INKJET PRINTING HEAD

(71) Applicant: ROHM CO., LTD., Kyoto (JP)

(72) Inventor: Wataru Kira, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/657,732

(22) Filed: Jul. 24, 2017

(65) Prior Publication Data

US 2018/0029365 A1 Feb. 1, 2018

(30) Foreign Application Priority Data

Jul. 26, 2016 (JP) ..... 2016-146625

(51) Int. Cl.
*B41J 2/14* (2006.01)

(52) U.S. Cl.
CPC ..... *B41J 2/14048* (2013.01); *B41J 2/14233* (2013.01); *B41J 2/1404* (2013.01); *B41J 2002/14241* (2013.01); *B41J 2002/14266* (2013.01)

(58) Field of Classification Search
CPC ..... B41J 2/14048; B41J 2/14233
See application file for complete search history.

(56) References Cited

U.S. PATENT DOCUMENTS

2010/0245507 A1* 9/2010 Kobayashi ..... B41J 2/17559 347/93

FOREIGN PATENT DOCUMENTS

JP 2015-91668 A 5/2015

* cited by examiner

*Primary Examiner* — Bradley Thies
(74) *Attorney, Agent, or Firm* — Hamre, Schumann, Mueller & Larson, P.C.

(57) ABSTRACT

An inkjet printing head 1 includes an actuator substrate, having an ink flow passage that includes a pressure chamber, a movable film formation layer, including a movable film, disposed on the pressure chamber and defining a top surface portion of the pressure chamber, a piezoelectric element 9, formed on the movable film, and a protective substrate 4, bonded to the actuator substrate so as to cover the piezoelectric element 9, and the protective substrate 4 has an ink supply passage 53 in communication with the ink flow passage, and on a surface of the protective substrate 4 at an opposite side from the actuator substrate, an alignment mark 81 is formed in each of a plurality of small regions set by dividing an entire region of the surface.

16 Claims, 23 Drawing Sheets

INKJET PRINTING HEAD

BACKGROUND OF THE INVENTION

1. Field of the invention

The present invention relates to an inkjet printing head.

2. Description of the Related Art

Japanese Patent Application Publication No. 2015-91668 discloses an inkjet printing head. The inkjet printing head of Japanese Patent Application Publication No. 2015-91668 includes an actuator substrate (substrate), having a pressure chamber (pressure generating chamber) as an ink flow passage, a movable film (elastic film), formed on the actuator substrate, and a piezoelectric element, provided above the movable film. The inkjet printing head of Japanese Patent Application Publication No. 2015-91668 further includes a nozzle substrate (nozzle plate), bonded to a lower surface of the actuator substrate and having a nozzle opening in communication with the pressure chamber, and a protective substrate, bonded to an upper surface of the actuator substrate and covering the piezoelectric element.

An individual ink supply passage, in communication with the pressure chamber, and a common ink supply passage (communicating portion), in communication with the individual ink supply passage, are formed in the actuator substrate. That is, the ink flow passage, including the common ink supply passage, the individual ink supply passage, and the pressure chamber, is formed in the actuator substrate. A housing recess (piezoelectric element holding portion), housing the piezoelectric element, is formed in a lower surface of the protective substrate. Also, in the protective substrate, an ink supply passage (reservoir portion), in communication with the common ink supply passage of the actuator substrate, is formed across an interval from the housing recess in plan view. Ink is supplied from an ink tank to the pressure chamber through the ink supply passage of the protective substrate and the common ink supply passage and the individual ink supply passage of the actuator substrate.

SUMMARY OF THE INVENTION

The inventor of preferred embodiments of the present invention described and claimed in the present application conducted an extensive study and research regarding an inkjet printing head, such as the one described above, and in doing so, discovered and first recognized new unique challenges and previously unrecognized possibilities for improvements as described in greater detail below.

The present inventor used a high precision camera (inspection camera) for semiconductor device inspection to take an image of the inkjet printing head from the protective substrate side and considered performing an appearance inspection using the taken image.

A planar shape of the inkjet printing head is, for example, an oblong shape of approximately 10 mm×30 mm and is wider than an image taking range of the inspection camera. It may thus be considered to divide an entire region of the inkjet printing head as viewed from the protective substrate side into a plurality of small regions in advance and take images according to each small region. In this case, a relative position of the inspection camera with respect to the inkjet printing head must beset so that for each small region, an image taking region of the inspection camera includes an entirety of the small region.

An object of the present invention is to provide an inkjet printing head that enables a relative position of an inspection camera with respect to an inkjet printing head to be set so that for each small region, an image taking region of the inspection camera includes an entirety of the small region.

In order to overcome the previously unrecognized and unsolved challenges described above, a preferred embodiment of the present invention provides an inkjet printing head. This inkjet printing head includes an actuator substrate, having an ink flow passage that includes a pressure chamber, a movable film formation layer, including a movable film, disposed on the pressure chamber and defining a top surface portion of the pressure chamber, a piezoelectric element, formed on the movable film, and a protective substrate, bonded to the actuator substrate so as to cover the piezoelectric element. The protective substrate has a housing recess, opening toward the actuator substrate and housing the piezoelectric element, and an ink supply passage in communication with the ink flow passage. On a surface of the protective substrate at an opposite side from the actuator substrate, an inspection camera positioning alignment mark is formed in each of a plurality of small regions set by dividing an entire region of the surface.

With the present arrangement, a relative position of an inspection camera with respect to the inkjet printing head can be set using the inspection camera positioning alignment mark provided for each small region. Therefore, with the present arrangement, the relative position of the inspection camera with respect to the inkjet printing head can be set so that for each small region, an image taking region of the inspection camera includes an entirety of the small region.

In the preferred embodiment of the present invention, the protective substrate has formed therein an electrode pad exposing opening portion that penetrates through the protective substrate in a thickness direction.

In the preferred embodiment of the present invention, in a plan view of viewing from a direction normal to a major surface of the movable film, the top surface portion of the pressure chamber is a rectangle that is long in a predetermined first direction and the piezoelectric element has a peripheral edge that is receded further toward an interior of the pressure chamber than the movable film.

In the preferred embodiment of the present invention, a plurality of the pressure chambers are provided and the piezoelectric element is provided for each pressure chamber. In the plan view, the actuator substrate has a plurality of pressure chamber columns formed therein at intervals in the first direction, with each pressure chamber column being constituted of a plurality of the pressure chambers provided at intervals in a second direction orthogonal to the first direction.

In the preferred embodiment of the present invention, the ink supply passage includes a plurality of elongate rectangular ink supply passages, which, in the plan view, extend in the second direction and are disposed at intervals in the first direction.

In the preferred embodiment of the present invention, the small regions include small regions that include a portion of the elongate rectangular ink supply passages, and in at least one of the small regions that include a portion of the elongate rectangular ink supply passages, the alignment mark is formed in each of regions at both sides sandwiching the portion of the elongate rectangular ink supply passages.

In the preferred embodiment of the present invention, the electrode pad exposing opening portion includes an opening portion of rectangular shape in plan view, which, in between two predetermined adjacent elongate rectangular ink supply passages among the plurality of elongate rectangular ink supply passages, extends along the elongate rectangular ink supply passages.

In the preferred embodiment of the present invention, the piezoelectric element includes a lower electrode, formed on the movable film, a piezoelectric film, formed on the lower electrode, and an upper electrode, formed on the piezoelectric film.

In the preferred embodiment of the present invention, the upper electrode has, in the plan view, a peripheral edge receded further toward the interior of the pressure chamber than the movable film, and an upper wiring having, in the plan view, one end portion connected to an upper surface of the upper electrode and another end portion led out to an outer side of a peripheral edge of the pressure chamber, is further included.

In the preferred embodiment of the present invention, a hydrogen barrier film, covering at least entireties of side surfaces of the upper electrode and the piezoelectric film and covering an upper surface of the lower electrode, and an insulating film, formed on the hydrogen barrier film and disposed between the hydrogen barrier film and the upper wiring are further included. A contact hole, exposing a portion of the upper electrode, is formed in the hydrogen barrier film and the insulating film, and the one end portion of the upper wiring is connected to the upper electrode via the contact hole.

In the preferred embodiment of the present invention, a passivation film, formed on the insulating film and coating the wiring, is further included.

In the preferred embodiment of the present invention, two of the alignment marks are formed in each small region.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A preferred embodiment of the present invention shall now be described in detail with reference to the attached drawings.

Figure 1:
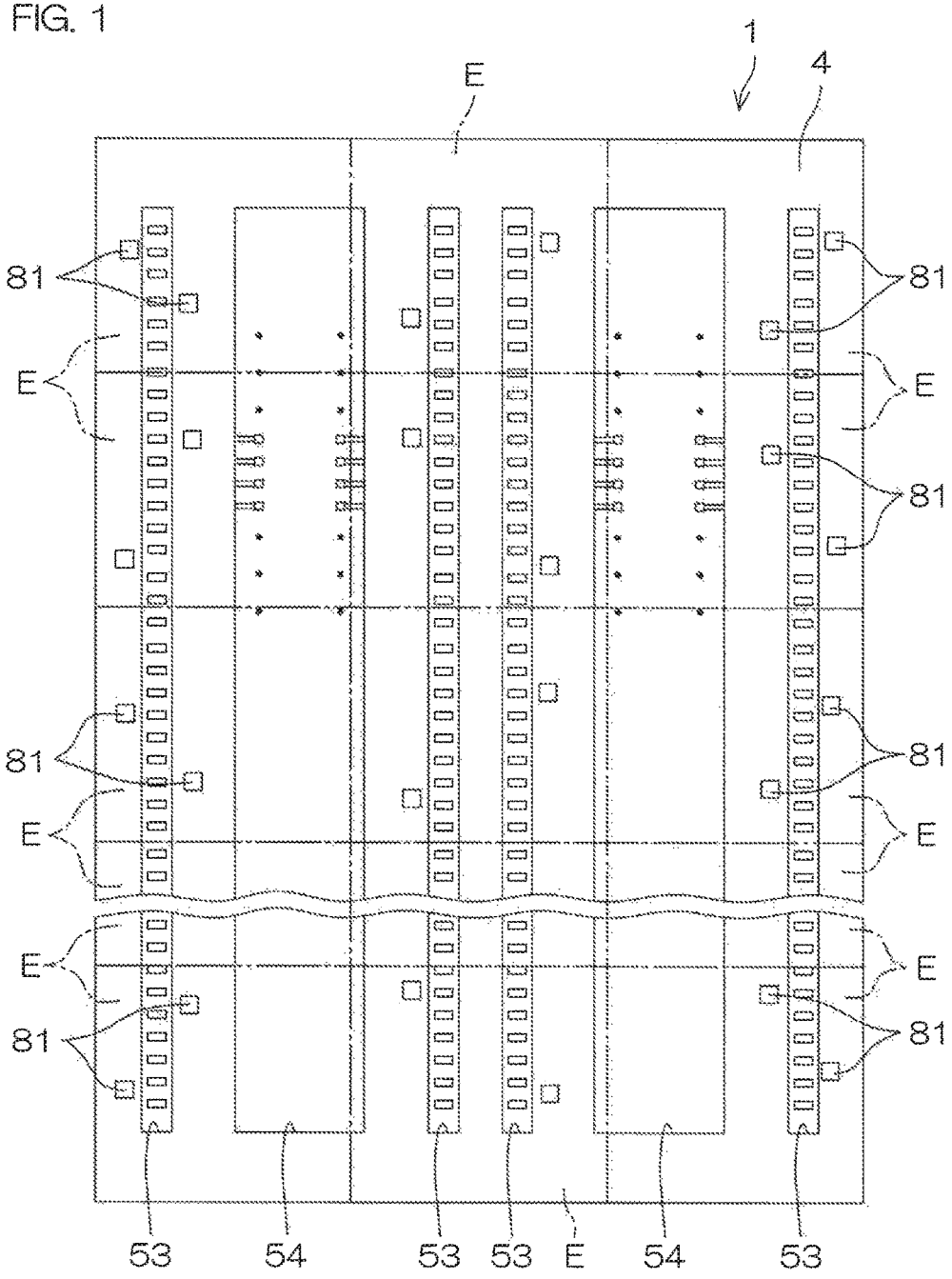
FIG. 1 is an illustrative plan view of an outer appearance of an inkjet printing head according to a preferred embodiment of the present invention.
Figure 2:
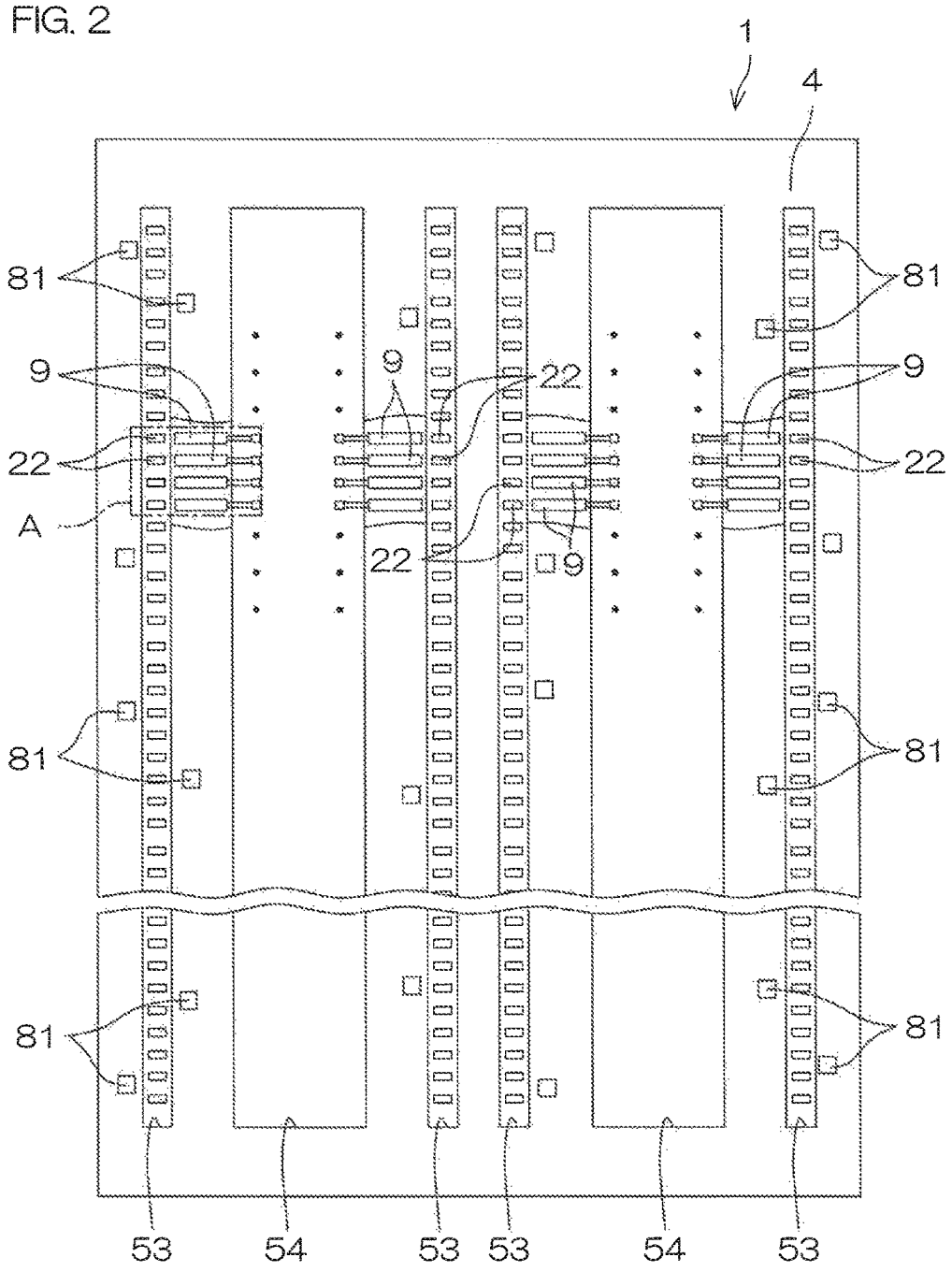
FIG. 2 is an illustrative partially cutaway plan view with which a portion of FIG. 1 has been cut away.
Figure 3:
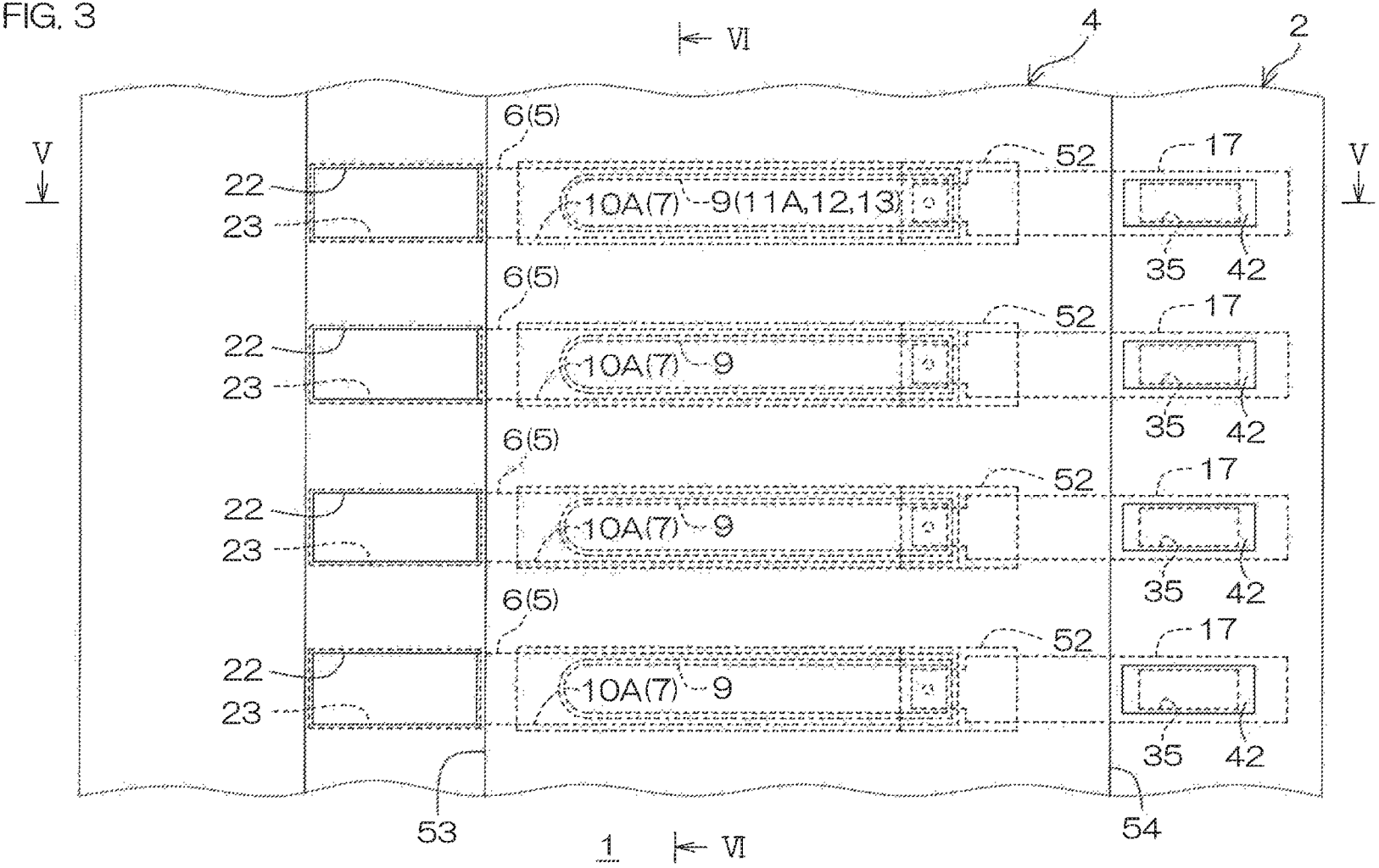
FIG. 3 is an illustrative plan view showing an A portion of FIG. 2 in enlarged manner and is a partially enlarged plan view that includes a protective substrate.
Figure 4:
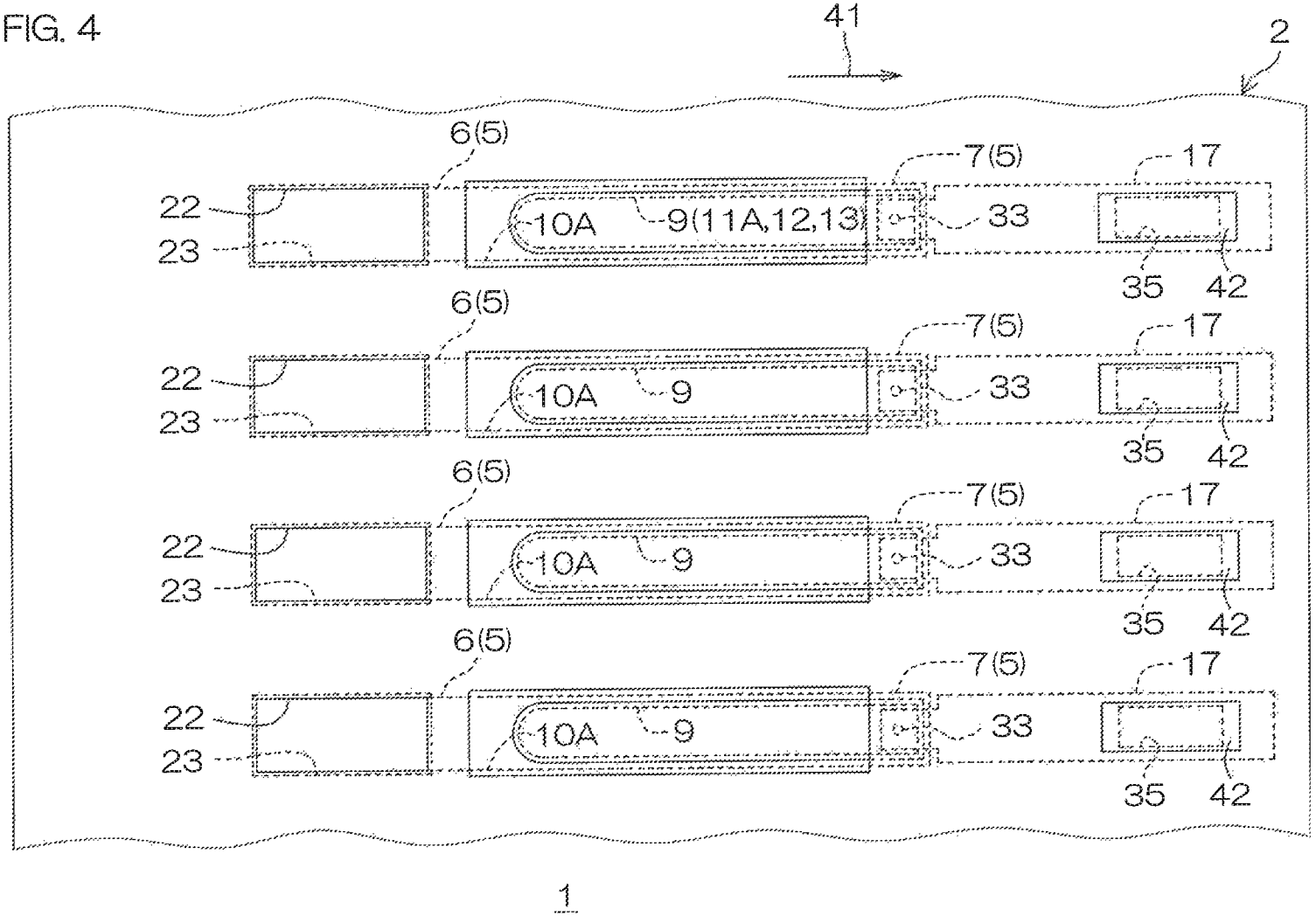
FIG. 4 is an illustrative plan view showing the A portion of FIG. 2 in enlarged manner and is a partially enlarged plan view from which the protective substrate is omitted.
Figure 5:
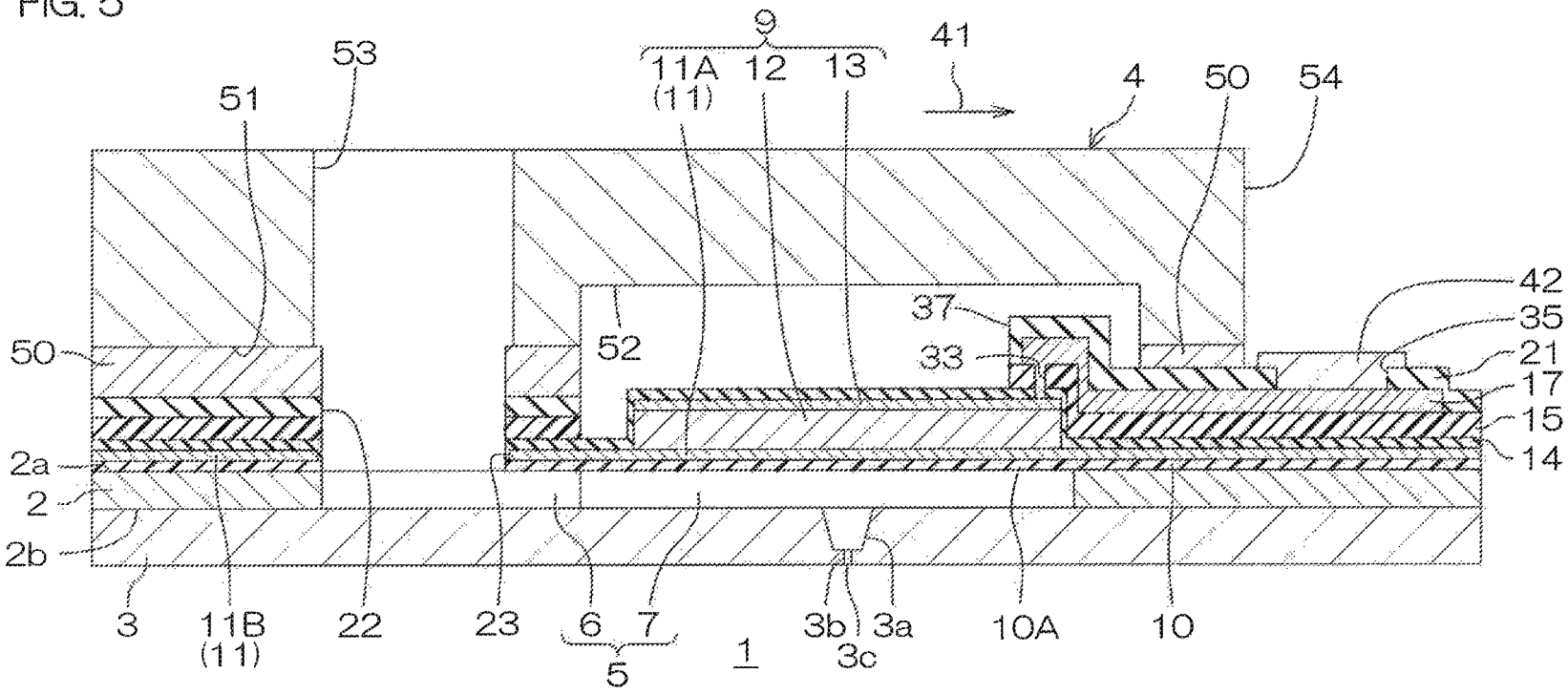
FIG. 5 is an illustrative sectional view taken along line V-V in FIG. 3.
Figure 6:
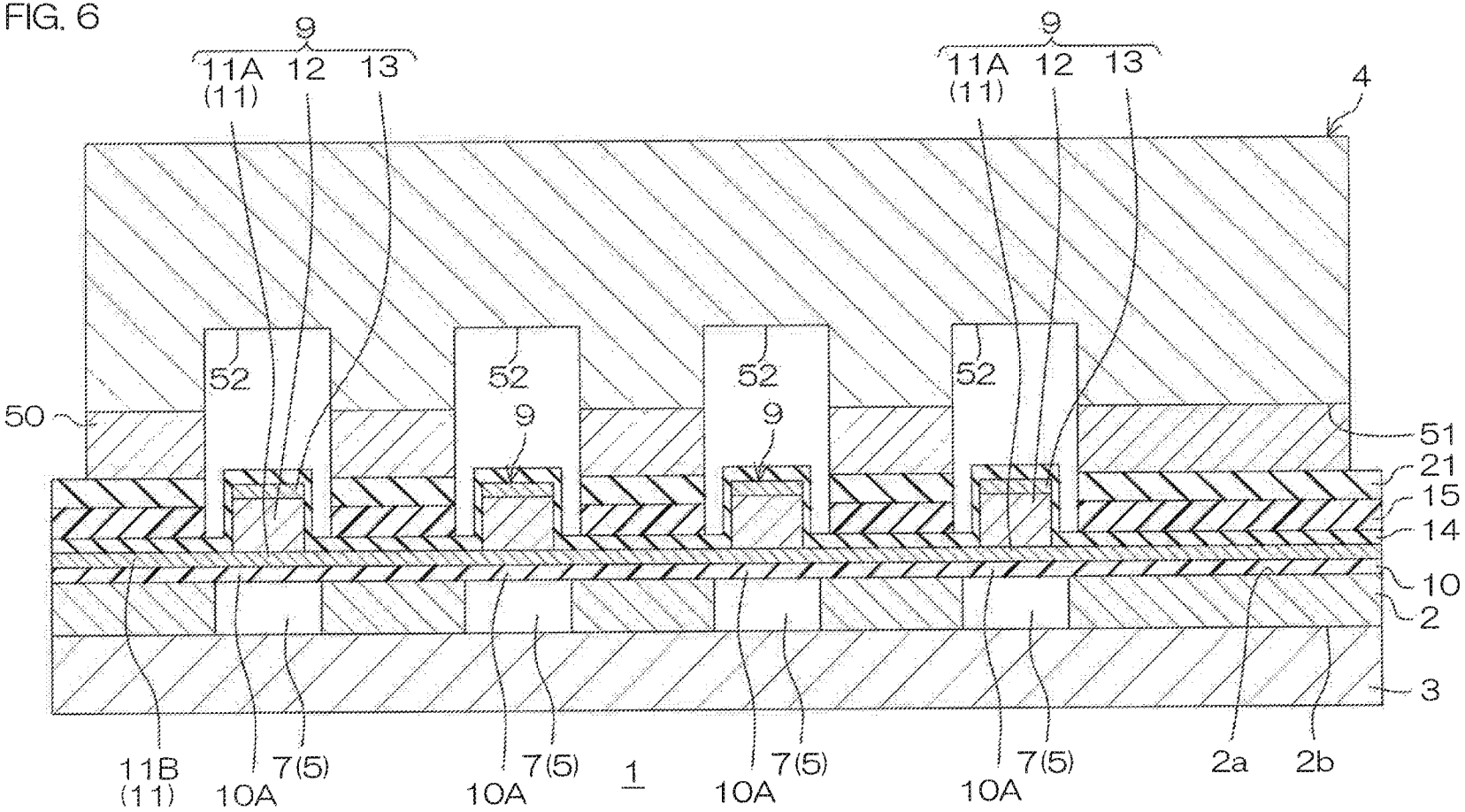
FIG. 6 is an illustrative sectional view taken along line VI-VI in FIG. 3.
Figure 7:
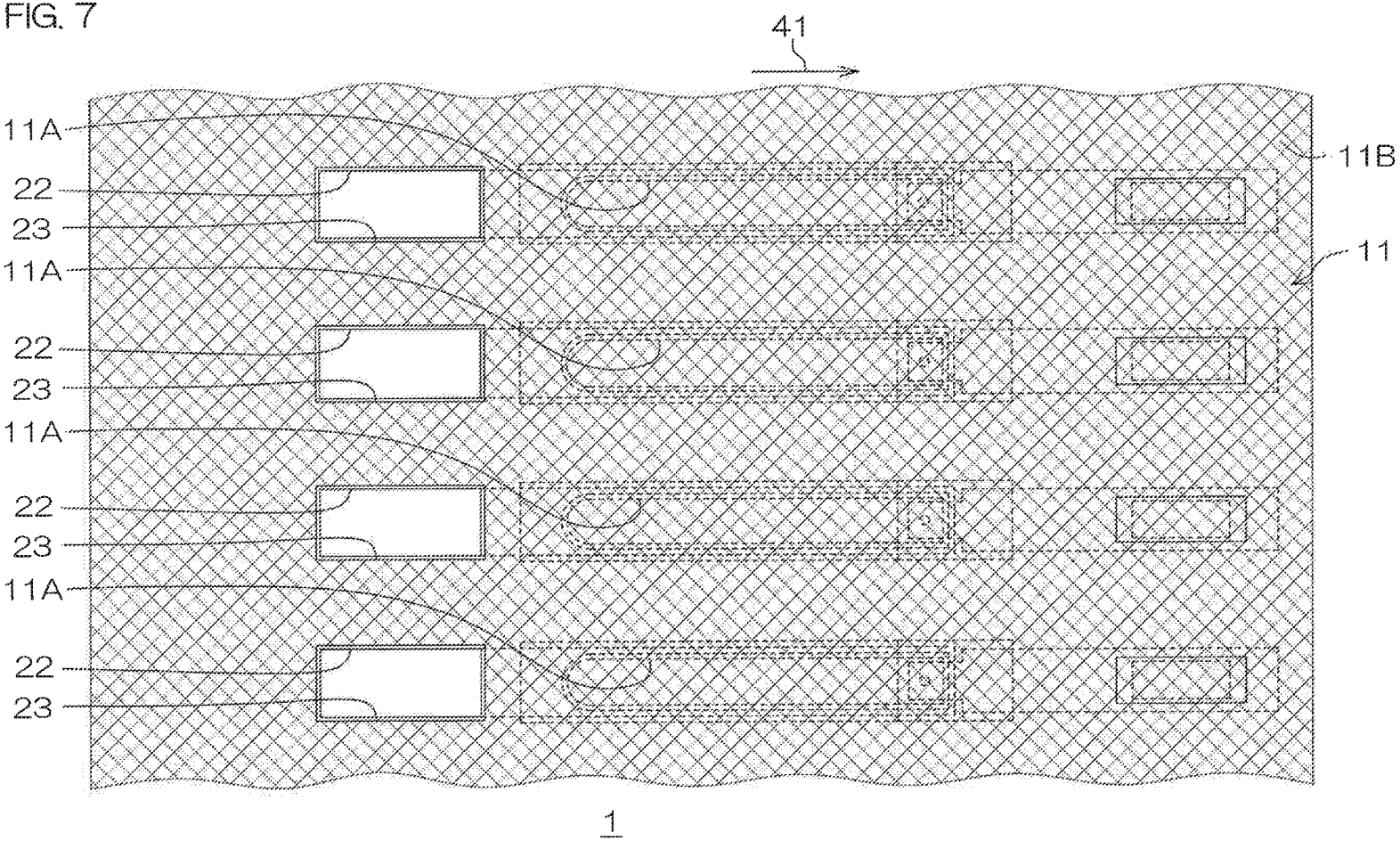
FIG. 7 is an illustrative partially enlarged plan view of a pattern example of a lower electrode of the inkjet printing head.

FIG. 1 is an illustrative plan view of an outer appearance of an inkjet printing head according to a preferred embodiment of the present invention. FIG. 2 is an illustrative partially cutaway plan view with which a portion of FIG. 1 has been cut away. FIG. 3 is an illustrative plan view showing an A portion of FIG. 2 in enlarged manner and is a partially enlarged plan view that includes a protective substrate. FIG. 4 is an illustrative plan view showing the A portion of FIG. 2 in enlarged manner and is a partially enlarged plan view from which the protective substrate is omitted. FIG. 5 is an illustrative sectional view taken along line V-V in FIG. 3. FIG. 6 is an illustrative sectional view taken along line VI-VI in FIG. 3. FIG. 7 is an illustrative partially enlarged plan view of a pattern example of a lower electrode of the inkjet printing head and is a plan view corresponding to FIG. 3.

The arrangement of an inkjet printing head 1 shall now be described in outline with reference to FIG. 5.

The inkjet printing head 1 includes an actuator substrate 2, a nozzle substrate 3, and a protective substrate 4. A movable film formation layer 10 is laminated on a front surface of the actuator substrate 2. In the actuator substrate 2, ink flow passages (ink reservoirs) 5 are formed. In the present preferred embodiment, the ink flow passages 5 are formed to penetrate through the actuator substrate 2. Each ink flow passage 5 is formed to be elongate along an ink flow direction 41, which is indicated by an arrow in FIG. 5. Each ink flow passage 5 is constituted of an ink inflow portion 6 at an upstream side end portion (left end portion in FIG. 5)

in the ink flow direction 41 and a pressure chamber 7 in communication with the ink inflow portion 6. In FIG. 2, a boundary between the ink inflow portion 6 and the pressure chamber 7 is indicated by an alternate long and two short dashed line.

The nozzle substrate 3 is constituted, for example, of a silicon substrate. The nozzle substrate 3 is adhered to a rear surface 2*b* of the actuator substrate 2. The nozzle substrate 3, together with the actuator substrate 2 and the movable film formation layer 10, defines the ink flow passages 5. More specifically, the nozzle substrate 3 defines bottom surface portions of the ink flow passages 5. The nozzle substrate 3 has recess portions 3*a* each facing a pressure chamber 7 and an ink discharge passage 3*b* is formed in a bottom surface of each recess portion 3*a*. Each ink discharge passage 3*b* penetrates through the nozzle substrate 3 and has a discharge port 3*c* at an opposite side from the pressure chamber 7. Therefore, when a volume change occurs in a pressure chamber 7, the ink retained in the pressure chamber 7 passes through the ink discharge passage 3*b* and is discharged from the discharge port 3*c*.

Each portion of the movable film formation layer 10 that is a top roof portion of a pressure chamber 7 constitutes a movable film 10A. The movable film 10A (movable film formation layer 10) is constituted, for example, of a silicon oxide ($SiO_2$) film formed on the actuator substrate 2. The movable film 10A (movable film formation layer 10) may be constituted of a laminated film, for example, of a silicon (Si) film formed on the actuator substrate 2, a silicon oxide ($SiO_2$) film formed on the silicon film, and a silicon nitride (SiN) film formed on the silicon oxide film. In the present specification, the movable film 10A refers to a top roof portion of the movable film formation layer 10 that defines the top surface portion of the pressure chamber 7. Therefore, portions of the movable film formation layer 10 besides the top roof portions of the pressure chambers 7 do not constitute the movable film 10A.

Each movable film 10A has a thickness of, for example, 0.4 μm to 2 μm. If the movable film 10A is constituted of a silicon oxide film, the thickness of the silicon oxide film may be approximately 1.2 μm. If the movable film 10A is constituted of a laminated film of a silicon film, a silicon oxide film, and a silicon nitride film, the thickness of each of the silicon film, the silicon oxide film, and the silicon nitride film may be approximately 0.4 μm.

Each pressure chamber 7 is defined by a movable film 10A, the actuator substrate 2, and the nozzle substrate 3 and is formed to a substantially rectangular parallelepiped shape in the present preferred embodiment. The pressure chamber 7 may, for example, have a length of approximately 800 μm and a width of approximately 55 μm. Each ink inflow portion 6 is in communication with one end portion in a long direction of a pressure chamber 7.

A piezoelectric element 9 is disposed on a front surface of each movable film 10A. Each piezoelectric element 9 includes a lower electrode 11 formed on the movable film formation layer 10, a piezoelectric film 12 formed on the lower electrode 11, and an upper electrode 13 formed on the piezoelectric film 12. In other words, the piezoelectric element 9 is arranged by sandwiching the piezoelectric film 12 from above and below by the upper electrode 13 and the lower electrode 11.

The upper electrode 13 may be a single film of platinum (Pt) or may have a laminated structure, for example, in which a conductive oxide film (for example, an $IrO_2$ (iridium oxide) film) and a metal film (for example, an Ir (iridium) film) are laminated. The upper electrode 13 may have a thickness, for example, of approximately 0.2 μm.

As each piezoelectric film 12, for example, a PZT ($PbZr_xTi_{1-x}O_3$: lead zirconate titanate) film formed by a sol-gel method or a sputtering method may be applied. Such a piezoelectric film 12 is constituted of a sintered body of a metal oxide crystal. The piezoelectric film 12 is formed to be of the same shape as the upper electrode 13 in plan view. The piezoelectric film 12 has a thickness of approximately 1 μm. The overall thickness of each movable film 10A is preferably approximately the same as the thickness of the piezoelectric film 12 or approximately ⅔ the thickness of the piezoelectric film 12.

The lower electrode 11 has, for example, a two-layer structure with a Ti (titanium) film and a Pt (platinum) film being laminated successively from the movable film formation layer 10 side. Besides this, the lower electrode 11 may be formed of a single film that is an Au (gold) film, a Cr (chromium) film, or an Ni (nickel) film, etc. The lower electrode 11 has main electrode portions 11A, in contact with lower surfaces of the piezoelectric films 12, and an extension portion 11B extending to a region outside the piezoelectric films 12. The lower electrode 11 may have a thickness, for example, of approximately 0.2 μm.

A hydrogen barrier film 14 is formed on the extension portion 11B of the lower electrode 11 and on the piezoelectric elements 9. The hydrogen barrier film 14 is constituted, for example, of $Al_2O_3$ (alumina). The hydrogen barrier film 14 has a thickness of approximately 50 nm to 100 nm. The hydrogen barrier film 14 is provided to prevent degradation of characteristics of the piezoelectric film 12 due to hydrogen reduction.

An insulating film 15 is laminated on the hydrogen barrier film 14. The insulating film 15 is constituted, for example, of $SiO_2$ or low-hydrogen SiN, etc. The insulating film 15 has a thickness of approximately 500 nm. Upper wirings 17 and a lower wiring (not shown) are formed on the insulating film 15. These wirings maybe constituted of a metal material including Al (aluminum). These wirings have a thickness, for example, of approximately 1000 nm (1 μm).

One end portion of each upper wiring 17 is disposed above one end portion (downstream side end portion in the ink flow direction 41) of an upper electrode 13. An upper electrode contact hole 33, penetrating continuously through the hydrogen barrier film 14 and the insulating film 15, is formed between the upper wiring 17 and the upper electrode 13. The one end portion of the upper wiring 17 enters into the upper electrode contact hole 33 and is connected to the upper electrode 13 inside the upper electrode contact hole 33. From above the upper electrode 13, the upper wiring 17 crosses an outer edge of the pressure chamber 7 and extends outside the pressure chamber 7.

Although unillustrated, the lower wiring is disposed above the extension portion 11B of the lower electrode 11 in a predetermined region in which the ink flow passages 5 are not formed in plan view. The lower wiring is connected to the extension portion 11B via a plurality of lower electrode contact holes (not shown) penetrating continuously through the hydrogen barrier film 14 and the insulating film 15 between the lower wiring and the extension portion 11B.

A passivation film 21, covering the upper wirings 17, the lower wiring, and the insulating film 15, is formed on the insulating film 15. The passivation film 21 is constituted, for example, of SiN (silicon nitride). The passivation film 21 may have a thickness, for example, of approximately 800 nm.

Upper electrode pad openings 35, each exposing a portion of an upper wiring 17, are formed in the passivation film 21. Each upper electrode pad opening 35 is formed in a region outside a pressure chamber 7 and is formed, for example, at a tip portion (end portion at an opposite side of a portion of contact with an upper electrode 13) of an upper wiring 17. Upper electrode pads 42, each covering an upper electrode pad opening 35, are formed on the passivation film 21. The upper electrode pads 42 enter into the upper electrode pad openings 35 and are connected to the upper wirings 17 inside the upper electrode pad openings 35. Although unillustrated, lower electrode pad openings, exposing portions of the lower wiring, are formed in the passivation film 21, and lower electrode pads, each covering a lower electrode pad opening and connected to the lower wiring, are formed on the passivation film 21.

Ink supply penetrating holes 22, being of rectangular shapes in plan view and penetrating through the passivation film 21, the insulating film 15, the hydrogen barrier film 14, the lower electrode 11, and the movable film formation layer 10 are formed at positions corresponding to end portions of the ink flow passages 5 at the ink inflow portion 6 sides. Penetrating holes 23, each being of rectangular shape in plan view, including an ink supply penetrating hole 22, and being larger than the ink supply penetrating hole 22, are formed in the lower electrode 11. The hydrogen barrier film 14 enters into gaps between the penetrating holes 23 in the lower electrode 11 and the ink supply penetrating holes 22. The ink supply penetrating holes 22 are in communication with the ink inflow portions 6.

The protective substrate 4 is constituted, for example, of a silicon substrate. The protective substrate 4 is disposed above the actuator substrate 2 so as to cover the piezoelectric elements 9. The protective substrate 4 is bonded to the passivation film 21 via an adhesive 50. The protective substrate 4 has housing recesses 52 in a facing surface 51 that faces a front surface 2*a* of the actuator substrate 2. The piezoelectric elements 9 are housed inside the housing recesses 52. Further, the protective substrate 4 has formed therein ink supply passages 53, which are in communication with the ink supply penetrating holes 22, and opening portions (electrode pad exposing opening portions) 54, arranged to expose the upper electrode pads 42 and the lower electrode pads. The ink supply passages 53 and the opening portions 54 penetrate through the protective substrate 4. An ink tank (not shown) storing ink is disposed above the protective substrate 4.

Each piezoelectric element 9 is formed at a position facing a pressure chamber 7 across a movable film 10A. That is, the piezoelectric element 9 is formed to contact a front surface of the movable film 10A at the opposite side from the pressure chamber 7. Each pressure chamber 7 is filled with ink by the ink being supplied from the ink tank to the pressure chamber 7 through an ink supply passage 53, an ink supply penetrating hole 22, and an ink inflow portion 6. The movable film 10A defines a top surface portion of the pressure chamber 7 and faces the pressure chamber 7. The movable film 10A is supported by portions of the actuator substrate 2 at a periphery of the pressure chamber 7 and has flexibility enabling deformation in a direction facing the pressure chamber 7 (in other words, in the thickness direction of the movable film 10A).

The upper wirings 17 and the lower wiring (not shown) are connected to a drive circuit (not shown). Specifically, the upper electrode pads 42 and the drive circuit are connected via connecting metal members (not shown). The lower electrode pads and the drive circuit are connected via connecting metal members (not shown). When a drive voltage is applied from the drive circuit to a piezoelectric element 9, the piezoelectric film 12 deforms due to an inverse piezoelectric effect. The movable film 10A is thereby made to deform together with the piezoelectric element 9 to thereby bring about a volume change of the pressure chamber 7 and the ink inside the pressure chamber 7 is pressurized. The pressurized ink passes through the ink discharge passage 3*b* and is discharged as microdroplets from the discharge port 3*c*.

The arrangement of the inkjet printing head 1 shall now be described in further detail with reference to FIG. 1 to FIG. 7.

Referring to FIG. 1 to FIG. 4, the shape in plan view of the inkjet printing head 1 is an oblong shape that is long in one direction (the up/down direction of the paper surface of FIG. 2). In the present preferred embodiment, the planar shapes and sizes of the actuator substrate 2, the protective substrate 4, and the nozzle substrate 3 are substantially the same as the planar shape and size of the inkjet printing head 1.

In plan view, the actuator substrate 2 is provided, at intervals in a direction along its short side, with four ink flow passage columns (pressure chamber columns), each constituted of a plurality of ink flow passages (pressure chambers) aligned in stripe form at intervals in a direction along alongside of the actuator substrate 2. In other words, in plan view, the actuator substrate 2 is provided, at intervals in the direction along its short side, with four pressure chamber columns, each constituted of a plurality of pressure chambers aligned in stripe format intervals in the direction along the long side of the actuator substrate 2.

Hereinafter, the ink flow passage column at the leftmost side of FIG. 2 shall be referred to as the first ink flow passage column, and the ink flow passage column adjacent to the right of the first ink flow passage column shall be referred to as the second ink flow passage column. Also, the ink flow passage column adjacent to the right of the second ink flow passage column shall be referred to as the third ink flow passage column, and the ink flow passage column adjacent to the right of the third ink flow passage column shall be referred to as the fourth ink flow passage column.

A pattern of the first ink flow passage column and a pattern of the second ink flow passage column are patterns that are right-left symmetrical with respect to a segment connecting centers between the columns. Therefore, whereas in the ink flow passages 5 included in the first ink flow passage column, the ink inflow portions 6 are at the left side with respect to the pressure chambers 7, in the ink flow passages 5 included in the second ink flow passage column, the ink inflow portions 6 are at the right side with respect to the pressure chambers 7. Therefore, between the first ink flow passage column and the second ink flow passage column, the ink flow directions 41 are mutually opposite directions.

A pattern of the third ink flow passage column is the same as the pattern of the first ink flow passage column and a pattern of the fourth ink flow passage column is the same as the pattern of the second ink flow passage column.

An ink supply penetrating hole 22 is provided for each of the plurality of ink flow passages 5 of each ink flow passage column. The ink supply penetrating holes 22 are disposed above the ink inflow portions 6. Therefore, the ink supply penetrating holes 22 for the ink flow passages 5 included in the first and third ink flow passage columns are disposed above left end portions of the ink flow passages 5, and the ink supply penetrating holes 22 for the ink flow passages 5 included in the second and fourth ink flow passage columns are disposed above right end portions of the ink flow passages 5.

A piezoelectric element 9 is provided for each of the plurality of ink flow passages 5 of each ink flow passage column. Hereinafter, the plurality of piezoelectric elements 9 provided respectively in accordance with the plurality of ink flow passages 5 of the first ink flow passage column may be referred to at times as the first piezoelectric element column, and the plurality of piezoelectric elements 9 provided respectively in accordance with the plurality of ink flow passages 5 of the second ink flow passage column maybe referred to at times as the second piezoelectric element column. Similarly, the plurality of piezoelectric elements 9 provided respectively in accordance with the plurality of ink flow passages 5 of the third ink flow passage column maybe referred to at times as the third piezoelectric element column, and the plurality of piezoelectric elements 9 provided respectively in accordance with the plurality of ink flow passages 5 of the fourth ink flow passage column may be referred to at times as the fourth piezoelectric element column.

In each ink flow passage column, the plurality of ink flow passages 5 are formed at equal intervals that are minute intervals (for example, of approximately 30 μm to 350 μm) in a width direction thereof. Each ink flow passage 5 is elongate along the ink flow direction 41. Each ink flow passage 5 is constituted of an ink inflow portion 6 in communication with an ink supply penetrating hole 22 and the pressure chamber 7 in communication with the ink inflow portion 6. In plan view, the pressure chamber 7 has an oblong shape that is elongate along the ink flow direction 41. That is, the top surface portion of the pressure chamber 7 has two side edges along the ink flow direction 41 and two end edges along a direction orthogonal to the ink flow direction 41. In plan view, the ink inflow portion 6 has substantially the same width as the pressure chamber 7. Each ink supply penetrating hole 22 is rectangular in plan view (see especially FIG. 4).

The lower electrode 11 is formed on substantially an entirety of a front surface of the movable film formation layer 10 (see especially FIG. 7). The lower electrode 11 is a common electrode used in common for the plurality of piezoelectric elements 9. The lower electrode 11 includes the main electrode portions 11A of rectangular shape in plan view that constitute the piezoelectric elements 9 and the extension portion 11B led out from the main electrode portions 11A in directions along the front surface of the movable film formation layer 10 to extend outside the peripheral edges of the top surface portions of the pressure chambers 7.

A length in a long direction of each main electrode portion 11A is shorter than the length in the long direction of each movable film 10A. Respective end edges of the main electrode portion 11A are disposed at inner sides at predetermined intervals respectively from the respective corresponding end edges of the movable film 10A. Also, a width in a short direction of the main electrode portion 11A is narrower than the width of the movable film 10A in the short direction. Respective side edges of the main electrode portion 10A are disposed at inner sides at predetermined intervals from the respective corresponding side edges of the movable film 10A. The extension portion 11B is a region of the entire region of the lower electrode 11 excluding the main electrode portions 11A.

In plan view, the upper electrodes 13 are formed to rectangular shapes of the same pattern as the main electrode portions 11A of the lower electrode 11. That is, a length in a long direction of each upper electrode 13 is shorter than the length in the long direction of each movable film 10A. Respective end edges of the upper electrode 13 are disposed at inner sides at predetermined intervals respectively from the respective corresponding end edges of the movable film 10A. Also, a width in a short direction of the upper electrode 13 is narrower than the width in the short direction of the movable film 10A. Respective side edges of the upper electrode 13 are disposed at inner sides at predetermined intervals from the respective corresponding side edges of the movable film 10A.

In plan view, the piezoelectric films 12 are formed to rectangular shapes of the same pattern as the upper electrodes 13. That is, a length in a long direction of each piezoelectric film 12 is shorter than the length in the long direction of each movable film 10A. Respective end edges of the piezoelectric film 12 are disposed at inner sides at predetermined intervals respectively from the respective corresponding end edges of the movable film 10A. Also, a width in a short direction of the piezoelectric film 12 is narrower than the width in the short direction of the movable film 10A. Respective side edges of the piezoelectric film 12 are disposed at inner sides at predetermined intervals from the respective corresponding side edges of the movable film 10A. A lower surface of the piezoelectric film 12 contacts an upper surface of the main electrode portion 11A of the lower electrode 11 and an upper surface of the piezoelectric film 12 contacts a lower surface of an upper electrode 13.

Each upper wiring 17 extends from an upper surface of one end portion (downstream side end portion in the ink flow direction 41) of the piezoelectric element 9, along an end surface of the piezoelectric element 9 continuous to the upper surface, and extends further along a front surface of the extension portion 11B of the lower electrode 11 in a direction along the ink flow direction 41. Tip portions of the upper wirings 17 are disposed inside opening portions 54 of the protective substrate 54. The pad openings 35, exposing central portions of tip portion front surfaces of the upper wirings 17, are formed in the passivation film 21. The pads 42 are provided on the passivation film 21 so as to cover the pad openings 35. The pads 42 are connected to the upper wirings 17 inside the pad openings 35.

As shown in FIG. 1, FIG. 2, FIG. 3, and FIG. 4, the protective substrate 4 has formed therein four ink supply passages 53, extending along its long side, at intervals in a direction along its short side. The ink supply passages 53 have rectangular shapes that are elongate in a direction along the long side of the protective substrate 4 in plan view. Hereinafter, the four ink supply passages 53 shall be referred to in an order starting from the left of FIG. 2 as the first column ink supply passage 53, the second column ink supply passage 53, the third column ink supply passage 53, and the fourth column ink supply passage 53.

The first column ink supply passage 53 is formed so as to surround, in plan view, the ink supply penetrating holes 22 for all ink flow passages 5 inside the first ink flow passage column and is in communication with these ink supply penetrating holes 22. The second column ink supply passage 53 is formed so as to surround, in plan view, the ink supply penetrating holes 22 for all ink flow passages 5 inside the second ink flow passage column and is in communication with these ink supply penetrating holes 22.

The third column ink supply passage 53 is formed so as to surround, in plan view, the ink supply penetrating holes 22 for all ink flow passages 5 inside the third ink flow passage column and is in communication with these ink supply penetrating holes 22. The fourth column ink supply passage 53 is formed so as to surround, in plan view, the ink supply penetrating holes 22 for all ink flow passages 5 inside the fourth ink flow passage column and is in communication with these ink supply penetrating holes 22.

In plan view, the first piezoelectric element column and the second piezoelectric element column are disposed between the first column ink supply passage 53 and the second column ink supply passage 53, and the third piezoelectric element column and the fourth piezoelectric element column are disposed between the third column ink supply passage 53 and the fourth column ink supply passage 53.

In the protective substrate 4, an opening portion (may hereinafter be referred to at times as the "first opening portion 54"), having a rectangular shape elongate in the direction along the long side of the protective substrate 4, is formed at a position between the first piezoelectric element column and the second piezoelectric element column in plan view. The first opening portion 54 is an opening portion arranged to expose the upper electrode pads 42 corresponding to the first piezoelectric element column, the upper electrode pads 42 corresponding to the second piezoelectric element column, and a single lower electrode pad (not shown) in common to these piezoelectric element columns.

Also, in the protective substrate 4, an opening portion 54 (may hereinafter be referred to at times as the "second opening portion 54"), having a rectangular shape elongate in the direction along the long side of the protective substrate 4, is formed at a position between the third piezoelectric element column and the fourth piezoelectric element column in plan view. The second opening portion 54 is an opening portion arranged to expose the upper electrode pads 42 corresponding to the third piezoelectric element column, the upper electrode pads 42 corresponding to the fourth piezoelectric element column, and a single lower electrode pad (not shown) in common to these piezoelectric element columns.

As shown in FIG. 1, a plurality of alignment marks (inspection camera positioning alignment marks) 81 are formed on a front surface of the protective substrate 4. The arrangement, method of use, etc., of the alignment marks 81 shall be described later.

Figure 10:
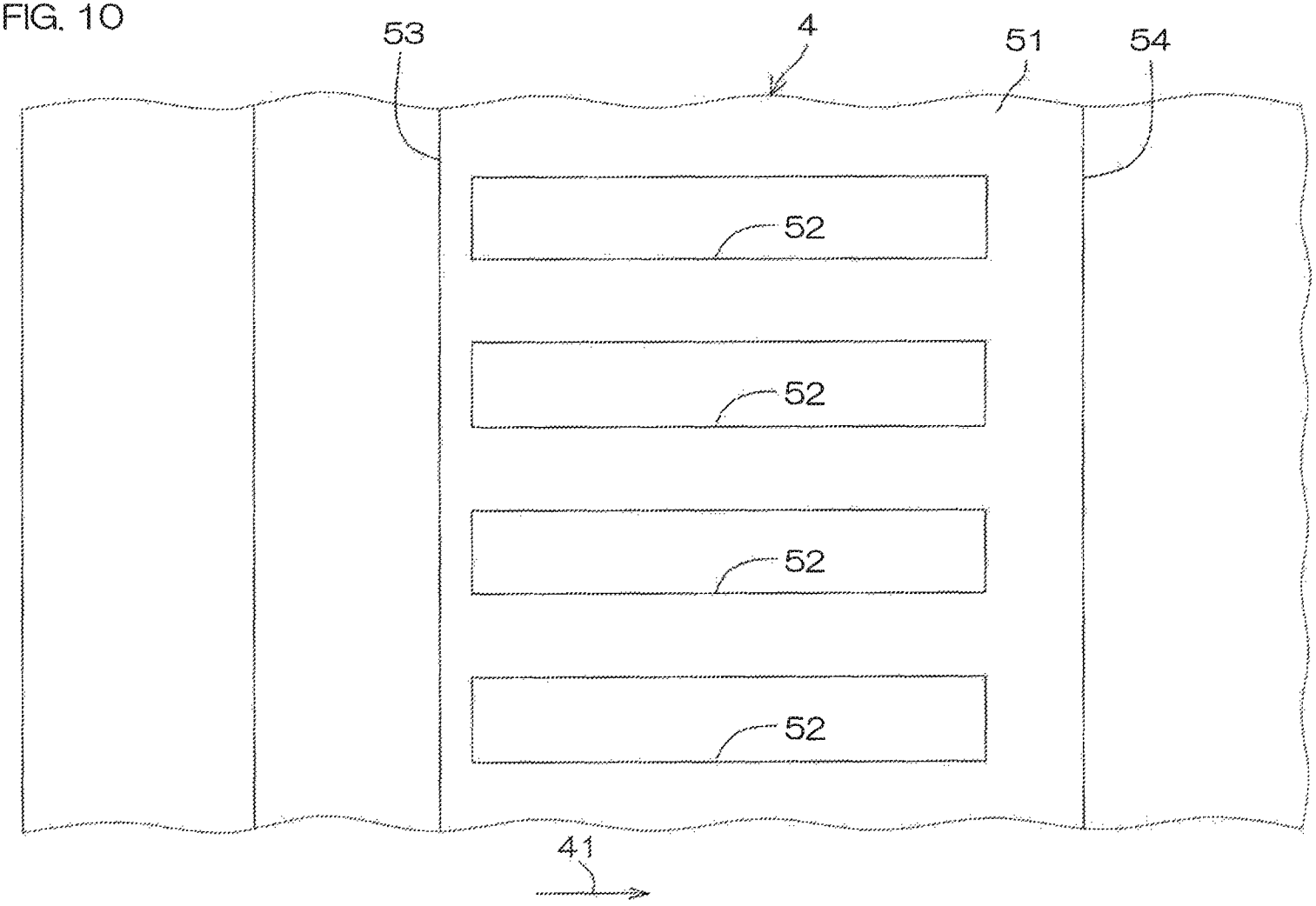
FIG. 10 is a bottom view of a region of the protective substrate shown in FIG. 3.

FIG. 10 is a bottom view of a region of the protective substrate shown in FIG. 3.

As shown in FIG. 2, FIG. 3, FIG. 5, FIG. 6, and FIG. 10, the housing recesses 52 are formed in the facing surface 51 of the protective substrate 4 respectively at positions facing the piezoelectric elements 9 inside the respective piezoelectric element columns. With respect to the respective housing recesses 52, the ink supply passages 53 are disposed at upstream sides in the ink flow direction 41 and the opening portions 54 are disposed at downstream sides. In plan view, each housing recess 52 is formed to a rectangular shape slightly larger than a pattern of the upper electrode 13 of the corresponding piezoelectric element 9. The corresponding piezoelectric element 9 is housed in each housing recess 52.

Figure 8:
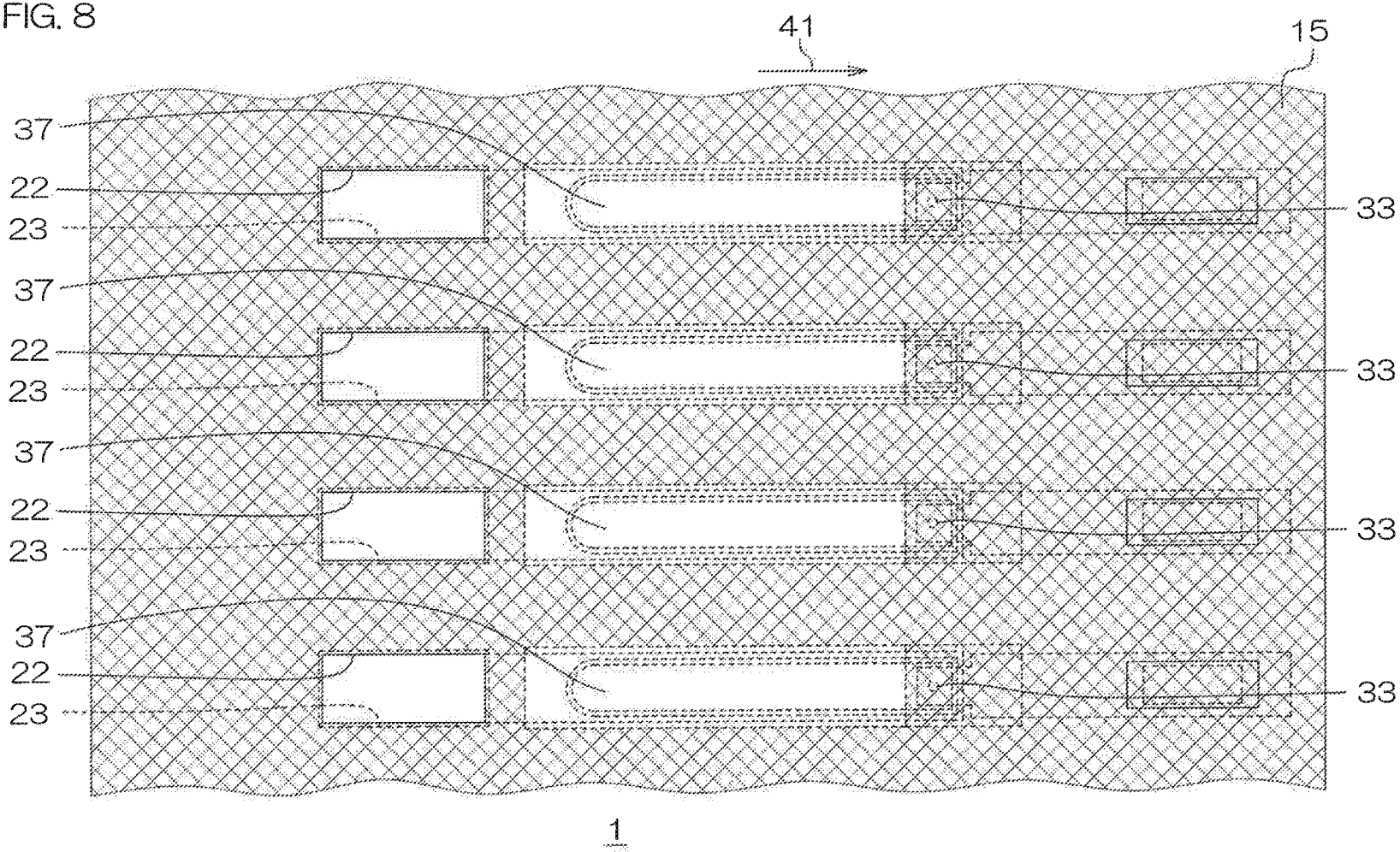
FIG. 8 is an illustrative partially enlarged plan view of a pattern example of an insulating film of the inkjet printing head.
Figure 9:
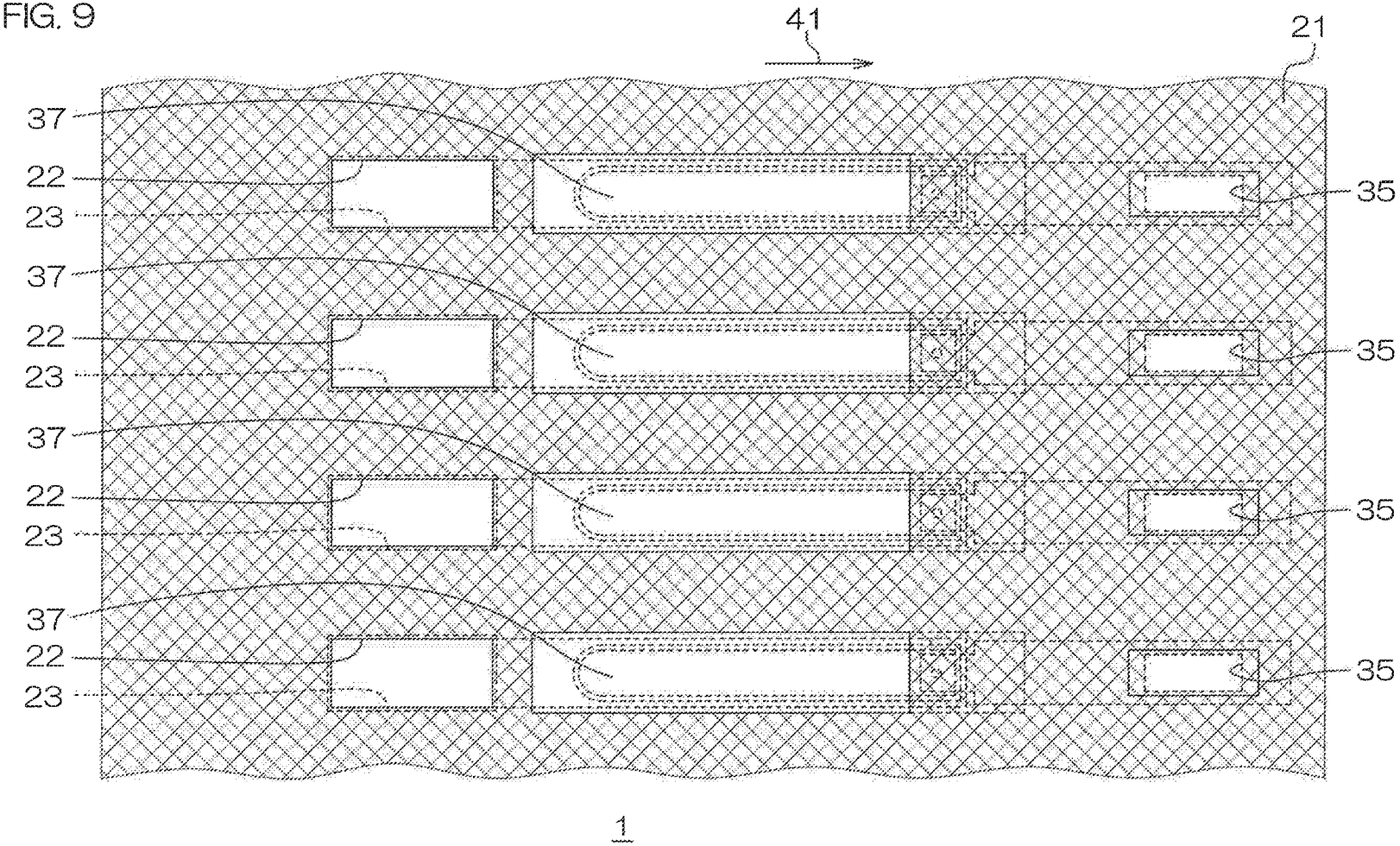
FIG. 9 is an illustrative partially enlarged plan view of a pattern example of a passivation film of the inkjet printing head.

FIG. 8 is an illustrative partially enlarged plan view of a pattern example of the insulating film of the inkjet printing head and is a plan view corresponding to FIG. 3. FIG. 9 is an illustrative partially enlarged plan view of a pattern example of the passivation film of the inkjet printing head and is a plan view corresponding to FIG. 3.

In the present preferred embodiment, above the actuator substrate 2, the insulating film 15 and the passivation film 21 are formed on substantially an entirety of a region of the protective substrate 4 outside the housing recesses 52 in plan view. However, in this region, the ink supply penetrating holes 22 are formed in the insulating film 15. In this region, the ink supply penetrating holes 22, the upper electrode pad openings 35, and the lower electrode pad openings are formed in the passivation film 21.

In the regions of the protective substrate 4 at inner sides of the housing recesses 52, the insulating film 15 and the passivation film 21 are formed only in one end portions (upper wiring regions) in which the upper wirings 17 are present. In these regions, the passivation film 21 is formed to cover upper surfaces and side surfaces of the upper wirings 17 on the insulating film 15. In other words, in the insulating film 15 and the passivation film 21, openings 37 are formed in regions, within the inner side regions of the housing recesses 52 in plan view, that exclude the upper wiring regions. The upper electrode contact holes 33 are further formed in the insulating film 15.

The alignment marks 81 shall now be described with reference to FIG. 1.

The alignment marks 81 are provided for positioning an image taking region of an inspection camera. In other words, the alignment marks 81 are positioned for positioning a relative position of the inspection camera with respect to the inkjet printing head 1.

An appearance inspection using a high precision camera (inspection camera) for semiconductor device inspection is performed on the inkjet printing head 1 according to the present preferred embodiment. Specifically, an image of the inkjet printing head 1 is taken by the inspection camera from the protective substrate 4 side. The appearance inspection of the inkjet printing head 1 is performed based on the taken image.

A planar shape of the inkjet printing head 1 according to the present preferred embodiment is, for example, an oblong shape of approximately 10 mm×30 mm and is wider than an image taking range of the inspection camera. An entire region of the inkjet printing head 1 as viewed from the protective substrate 4 side is thus divided into a plurality of small regions in advance and images are taken according to each small region. In this case, a relative position of the inspection camera with respect to the inkjet printing head 1 must be set so that for each small region, the image taking region of the inspection camera includes an entirety of the small region.

Thus, with the present preferred embodiment, the alignment marks 81 for setting the relative position of the inspection camera with respect to the inkjet printing head 1 are provided for each small region. In the present preferred embodiment, an upper surface of the protective substrate 4 is divided into three portions in a lateral direction and divided into eight portions in a vertical direction as indicated by dot-dashed lines in FIG. 1 and thereby divided into 24 small regions E. Two alignment marks 81 are provided in each small region E. Positions of the two alignment marks 81 provided in each small region E are determined in advance. However, these positions may be determined arbitrarily. The positions of the two alignment marks 81 on a basis of a center of a small region E may differ according to each small region E or may be the same in all small regions E or may not be the same in all small regions E but the same in a portion of the small regions E.

In the present preferred embodiment, a portion of any of the ink supply passages 53 is present in all small regions E. In each small region E, the alignment marks 81 are formed respectively in regions at both sides sandwiching an ink supply passage 53.

In the appearance inspection, an image of the alignment marks 81 is taken by the inspection camera while changing the relative position of the inspection camera with respect to the inkjet printing head 1. Then, based on the positions, in the taken image, of the two alignment marks 81 inside the small region E that is the imaging object, the relative position of the inspection camera with respect to the inkjet printing head 1 is set at a preset position (optimal image taking position) suitable for taking the image of the small region E. An image of the small region E is then taken. Thereafter, by the same operations, the relative position of the inspection camera with respect to the inkjet printing head 1 is set at the optimal image taking position for the small region E that is the next imaging object. An image of this small region E is then taken. Such operations are repeated to take images of all of the small regions E.

Thus, with the present preferred embodiment, the alignment marks 81 provided for each small region are used to set the relative position of the inspection camera with respect to the inkjet printing head 1 at each optimal image taking position. It thereby becomes possible with the present preferred embodiment to set the relative position of the inspection camera with respect to the inkjet printing head 1 so that for each small region, the image taking region of the inspection camera includes the entirety of the small region.

Each alignment mark 81 is constituted of a recess formed in the front surface of the protective substrate 4. The alignment marks 81 may be formed, for example, by forming a thermal oxide film on the front surface of the protective substrate 4 and forming recesses in the thermal oxide film. Specifically, after forming the thermal oxide film on the front surface of the protective substrate 4, a resist mask, having openings corresponding to the respective alignment marks, is positioned on the thermal oxide film. The alignment marks 81 of a predetermined pattern are then formed by etching the thermal oxide film using the resist mask as a mask.

FIG. 11A to FIG. 11M are sectional views of an example of a manufacturing process of the inkjet printing head 1 and show a section corresponding to FIG. 5.

Figure 11A:
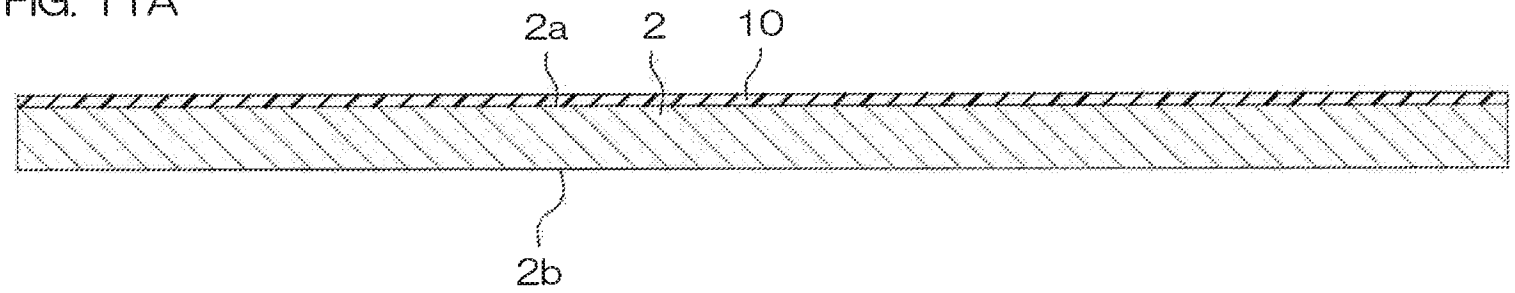
FIG. 11A is a sectional view of an example of a manufacturing process of the inkjet printing head.

First, as shown in FIG. 11A, the movable film formation layer 10 is formed on the front surface 2*a* of the actuator substrate 2. However, as the actuator substrate 2, that which is thicker than the thickness of the actuator substrate 2 at the final stage is used. Specifically, a silicon oxide film (for example, of 1.2 μm thickness) is formed on the front surface of the actuator substrate 2. If the movable film formation layer 10 is constituted of a laminated film of a silicon film, a silicon oxide film, and a silicon nitride film, the silicon film (for example, of 0.4 μm thickness) is formed on the front surface of the actuator substrate 2, the silicon oxide film (for example, of 0.4 μm thickness) is formed on the silicon film, and the silicon nitride film (for example, of 0.4 μm thickness) is formed on the silicon oxide film.

A base oxide film, for example, of $Al_2O_3$, MgO, or $ZrO_2$, etc., may be formed on the front surface of the movable film formation layer 10. Such base oxide films prevent metal atoms from escaping from the piezoelectric films 12 to be formed later. When metal electrons escape, the piezoelectric films 12 may degrade in piezoelectric characteristics. Also, when metal atoms that have escaped become mixed in the silicon layer constituting each movable film 10A, the movable film 10A may degrade in durability.

Figure 11B:
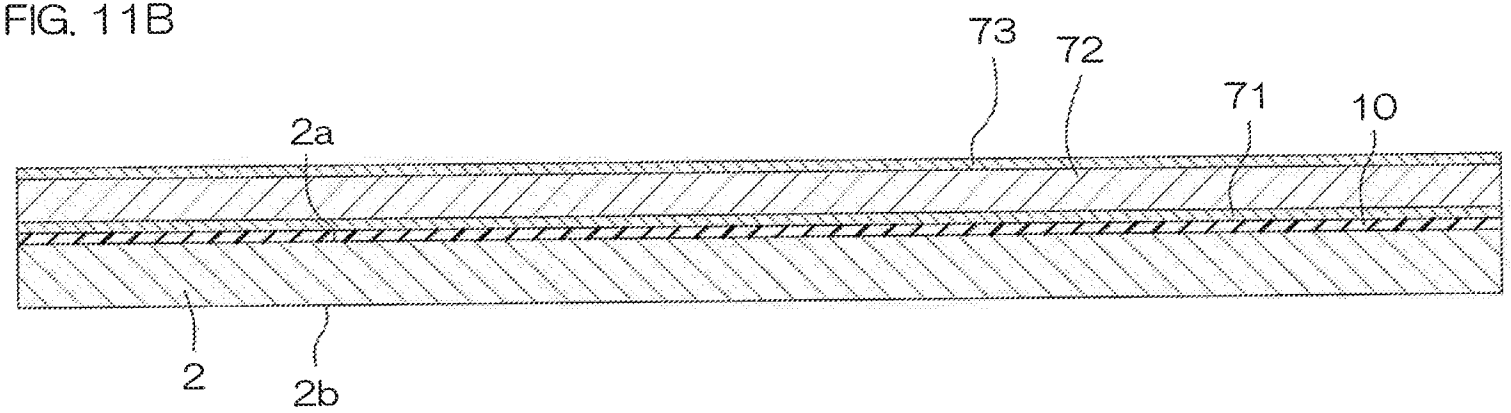
FIG. 11B is a sectional view of a step subsequent to that of FIG. 11A.

Next, as shown in FIG. 11B, a lower electrode film 71, which is a material layer of the lower electrode 11, is formed on the movable film formation layer 10 (on the base oxide film in the case where the base oxide film is formed). The lower electrode film 71 is constituted, for example, of a Pt/Ti laminated film having a Ti film (for example, of 10 nm to 40 nm thickness) as a lower layer and a Pt film (for example, of 10 nm to 400 nm thickness) as an upper layer. Such a lower electrode film 71 may be formed by a sputtering method.

Next, a material film (piezoelectric material film) 72 of the piezoelectric films 12 is formed on an entire surface on the lower electrode film 71. Specifically, for example, a piezoelectric material film 72 of 1 μm to 3 μm thickness is formed by a sol-gel method. Such a piezoelectric material film 72 is constituted of a sintered body of metal oxide crystal grains.

Next, an upper electrode film 73, which is a material of the upper electrodes 13, is formed on an entire surface of the piezoelectric material film 72. The upper electrode film 73 may, for example, be a single film of platinum (Pt). The upper electrode film 73 may, for example, be an $IrO_2$/Ir laminated film having an $IrO_2$ film (for example, of 40 nm to 160 nm thickness) as a lower layer and an Ir film (for example, of 40 nm to 160 nm thickness) as an upper layer. Such an upper electrode film 73 may be formed by the sputtering method.

Figure 11C:
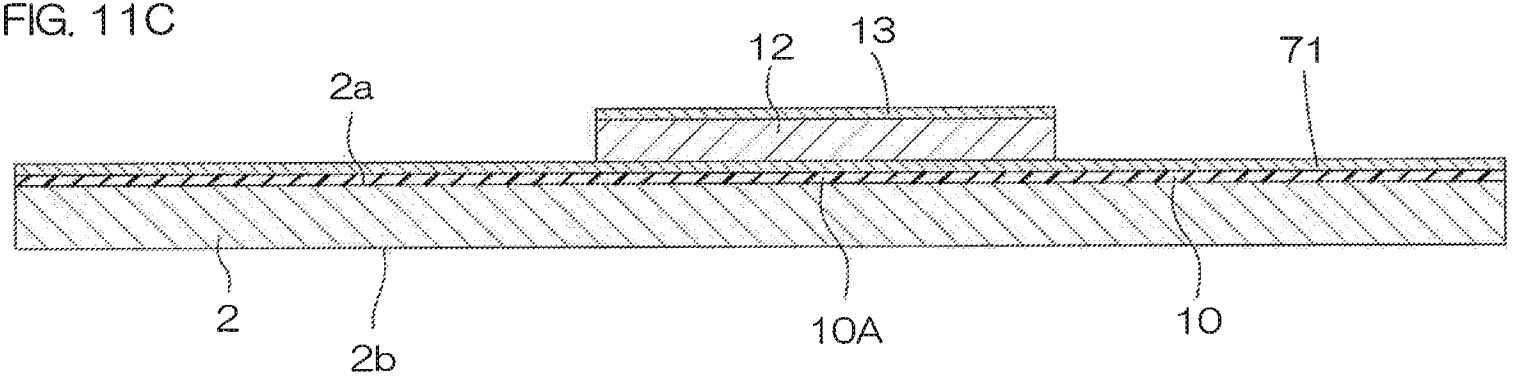
FIG. 11C is a sectional view of a step subsequent to that of FIG. 11B.
Figure 11D:
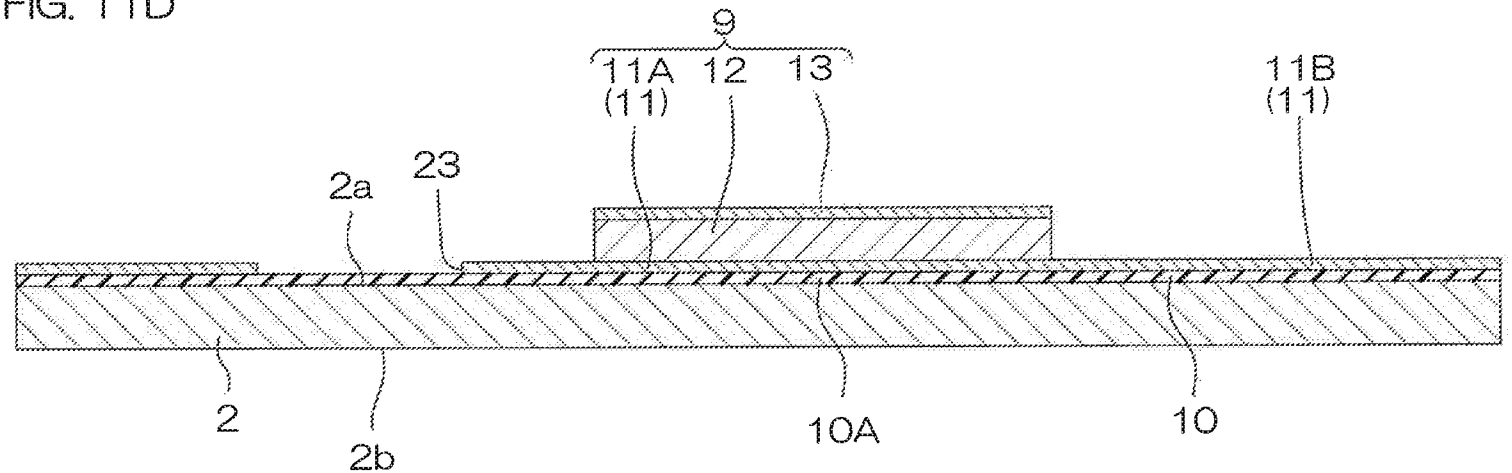
FIG. 11D is a sectional view of a step subsequent to that of FIG. 11C.

Next, patterning of the upper electrode film 73, the piezoelectric material film 72, and the lower electrode film 71 is performed as shown in FIG. 11C and FIG. 11D. First, a resist mask with the pattern of the upper electrodes 13 is formed by photolithography. Then, as shown in FIG. 11C, the upper electrode film 73 and the piezoelectric material film 72 are etched successively using the resist mask as a mask to form the upper electrodes 13 and the piezoelectric films 12 of the predetermined pattern.

Next, after peeling off the resist mask, a resist mask with a pattern of the lower electrode 11 is formed by photolithography. Then, as shown in FIG. 11D, the lower electrode film 71 is etched using the resist mask as a mask to form the lower electrode 11 of the predetermined pattern. The lower electrode 11, constituted of the main electrode portions 11A and the extension portion 11B having the penetrating holes 23, is thereby formed. The piezoelectric elements 9, constituted of the main electrode portions 11A of the lower electrode 11, the piezoelectric films 12, and the upper electrodes 13, are thereby formed.

Figure 11E:
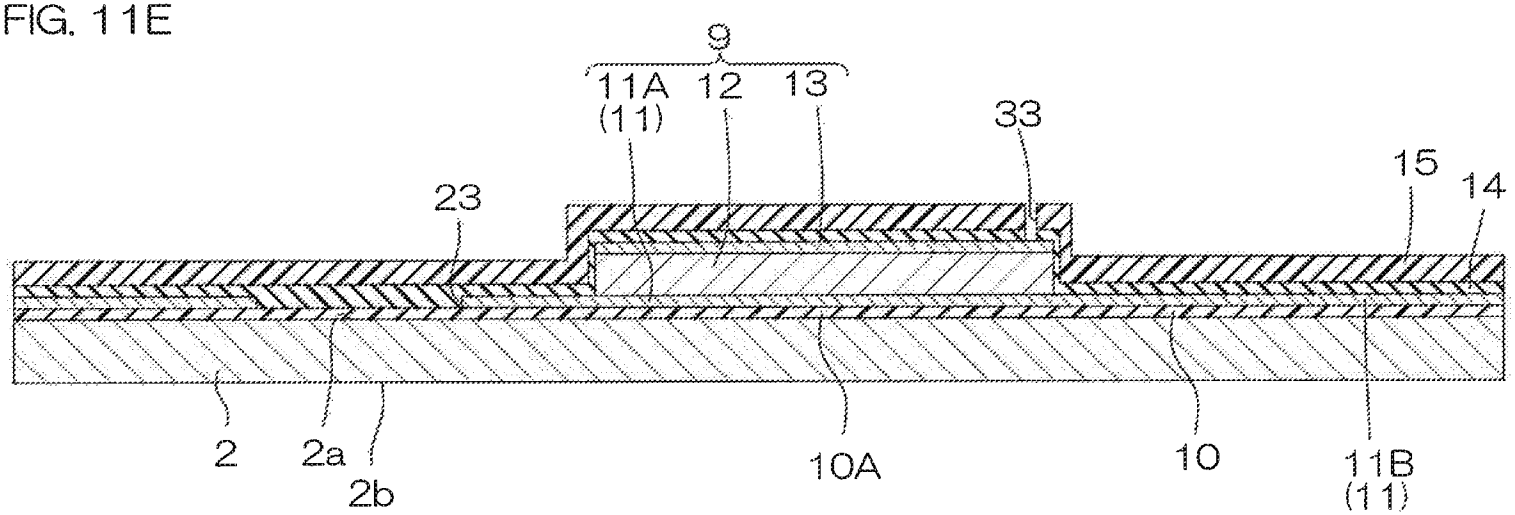
FIG. 11E is a sectional view of a step subsequent to that of FIG. 11D.

Next, after peeling off the resist mask, the hydrogen barrier film 14 covering the entire surface is formed as shown in FIG. 11E. The hydrogen barrier film 14 may be an $Al_2O_3$ film formed by the sputtering method and may have a film thickness of 50 nm to 100 nm. Thereafter, the insulating film 15 is formed on the entire surface of the hydrogen barrier film 14. The insulating film 15 may be an $SiO_2$ film and may have a film thickness of 200 nm to 300 nm. Next, the upper electrode contact holes 33 and the lower electrode contact holes are formed by successively etching the insulating film 15 and the hydrogen barrier film 14.

Figure 11F:
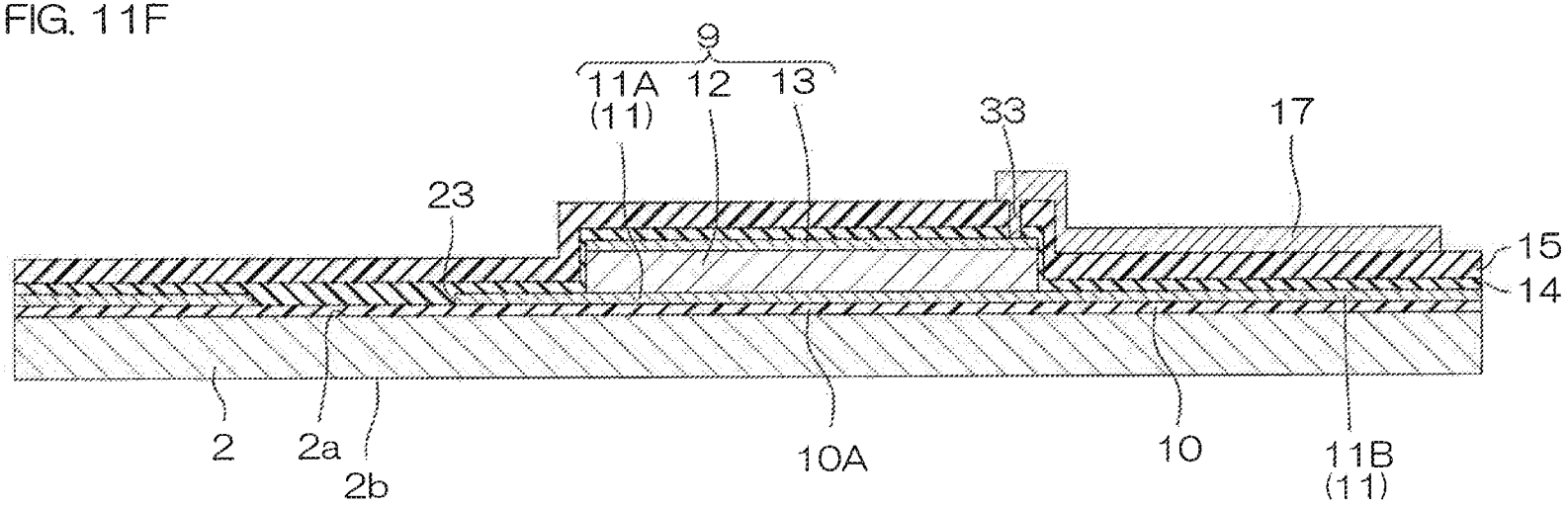
FIG. 11F is a sectional view of a step subsequent to that of FIG. 11E.

Next, as shown in FIG. 11F, a wiring film that constitutes the upper wirings 17 and the lower wiring is formed by the sputtering method on the insulating film 15 as well as inside the upper electrode contact holes 33 and the lower electrode contact holes. Thereafter, the wiring film is patterned by photolithography and etching to form the upper wirings 17 and the lower wiring at the same time.

Figure 11G:
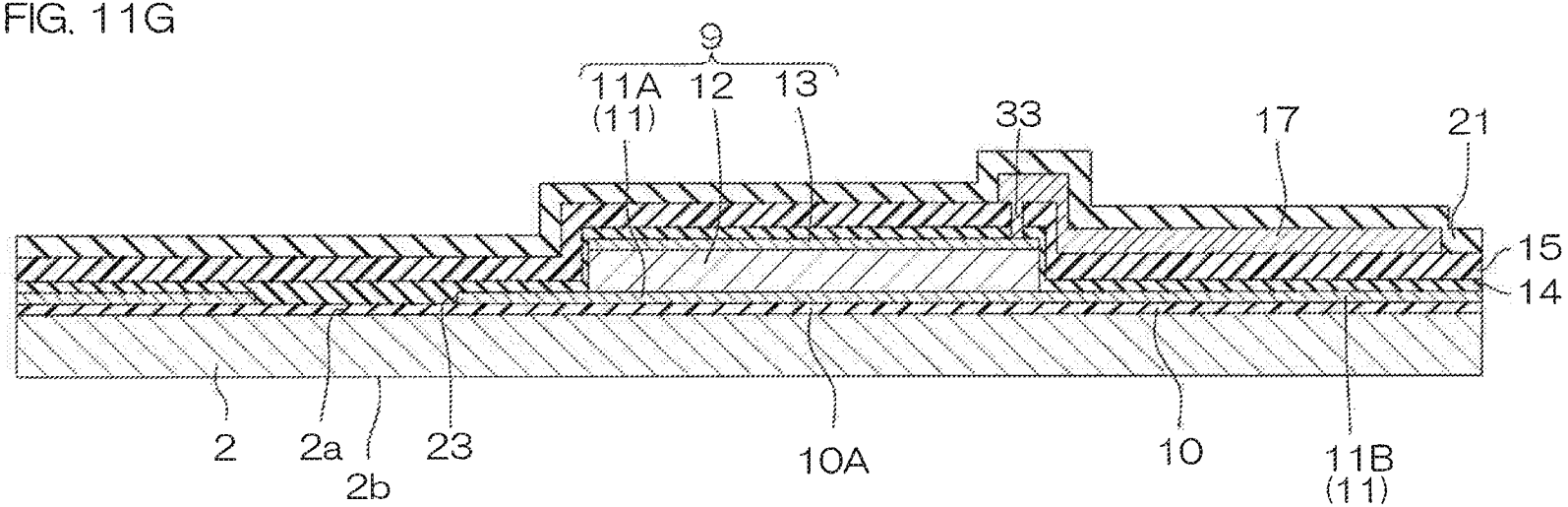
FIG. 11G is a sectional view of a step subsequent to that of FIG. 11F.

Next, as shown in FIG. 11G, the passivation film 21 that covers the upper wirings 17 and the lower wiring is formed on the front surface of the insulating film 15. The passivation film 21 is constituted, for example, of SiN. The passivation film 21 is formed, for example, by plasma CVD.

Figure 11H:
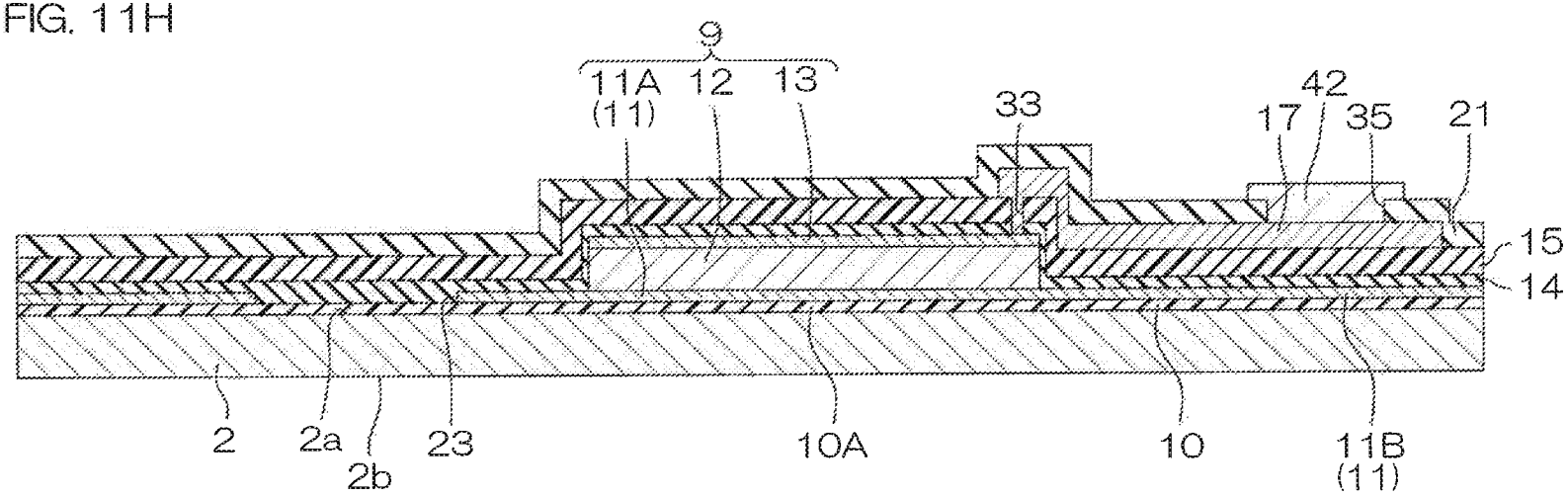
FIG. 11H is a sectional view of a step subsequent to that of FIG. 11G.

Next, a resist mask, having openings corresponding to the upper electrode pad openings 35 and the lower electrode pad openings, is formed by photolithography, and the passivation film 21 is etched using the resist mask as a mask. The upper electrode pad openings 35 and the lower electrode pad openings are thereby formed in the passivation film 21 as shown in FIG. 11H. After peeling off the resist mask, the upper electrode pads 42 and the lower electrode pads, connected respectively to the upper wirings 17 and the lower wiring via the upper electrode pad openings 35 and the lower electrode pad openings, are formed on the passivation film 21.

Figure 11I:
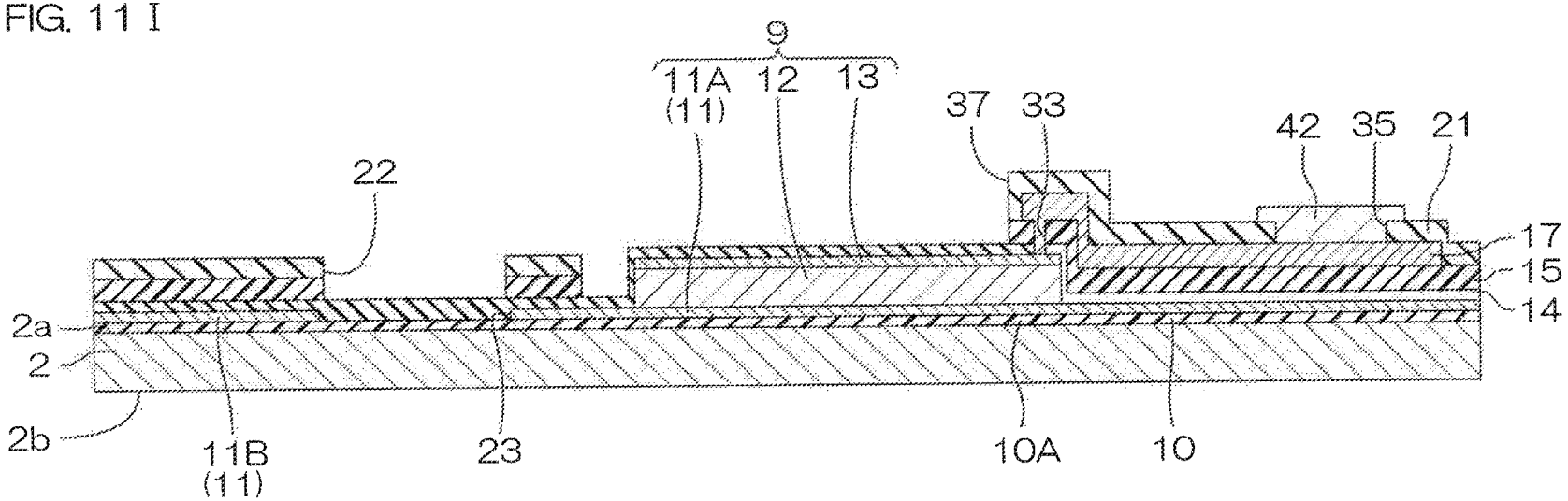
FIG. 11I is a sectional view of a step subsequent to that of FIG. 11H.

Next, a resist mask, having openings corresponding to the openings 37 and the ink supply penetrating holes 22, is formed by photolithography, and the passivation film 21 and the insulating film 15 are etched successively using the resist mask as a mask. The openings 37 and the ink supply penetrating holes 22 are thereby formed in the passivation film 21 and the insulating film 15 as shown in FIG. 11I.

Figure 11J:
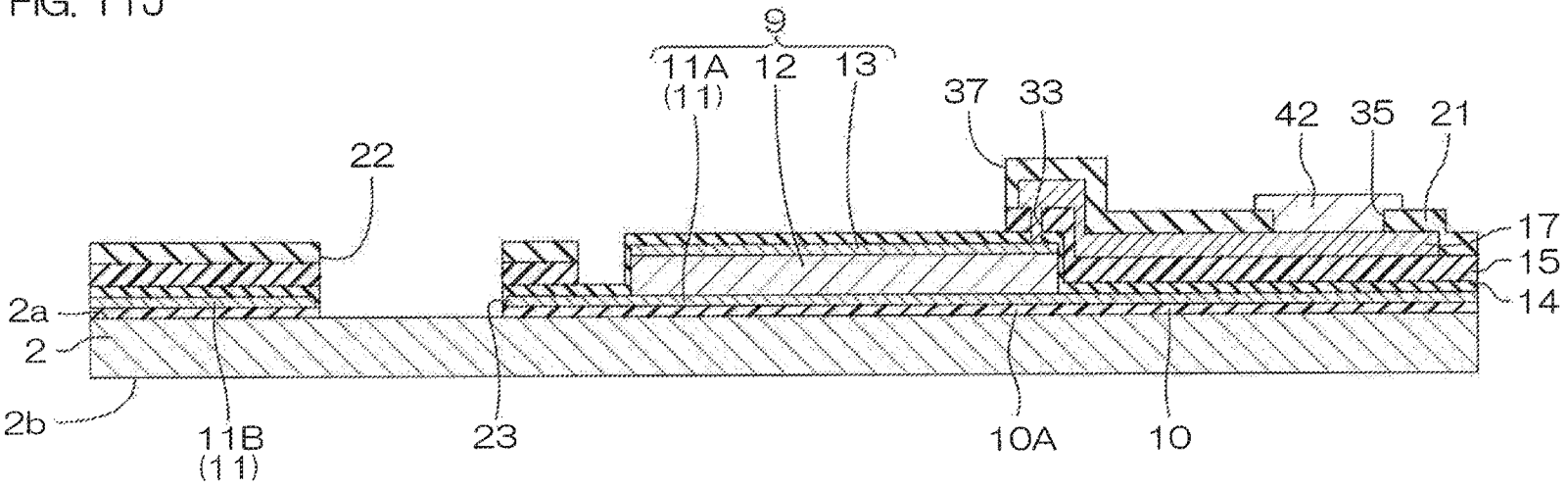
FIG. 11J is a sectional view of a step subsequent to that of FIG. 11I.

Next, the resist mask is peeled off. A resist mask having openings corresponding to the ink supply penetrating holes 22 is then formed by photolithography, and the hydrogen barrier film 14 and the movable film formation layer 10 are etched using the resist mask as a mask. The ink supply penetrating holes 22 are thereby formed in the hydrogen barrier film 14 and the movable film formation layer 10 as shown in FIG. 11J.

Figure 11K:
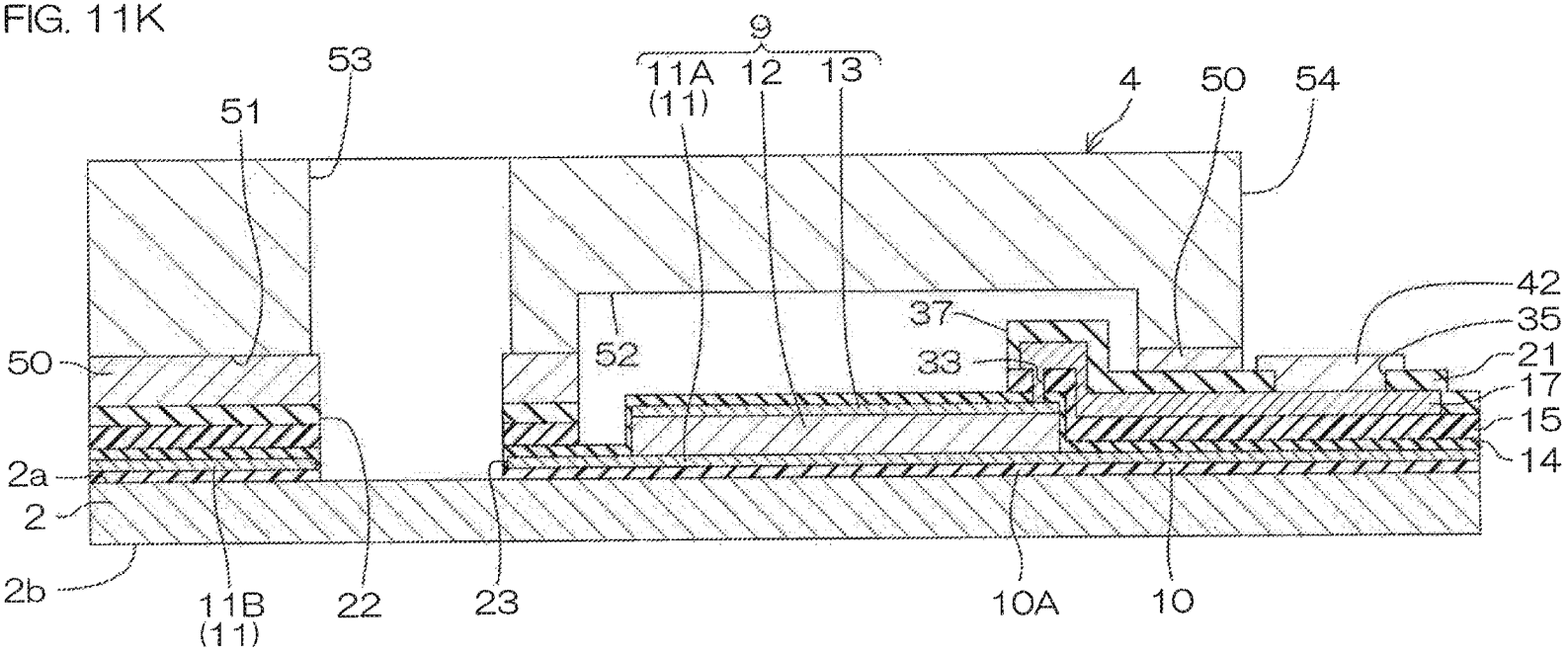
FIG. 11K is a sectional view of a step subsequent to that of FIG. 11J.
Figure 11L:
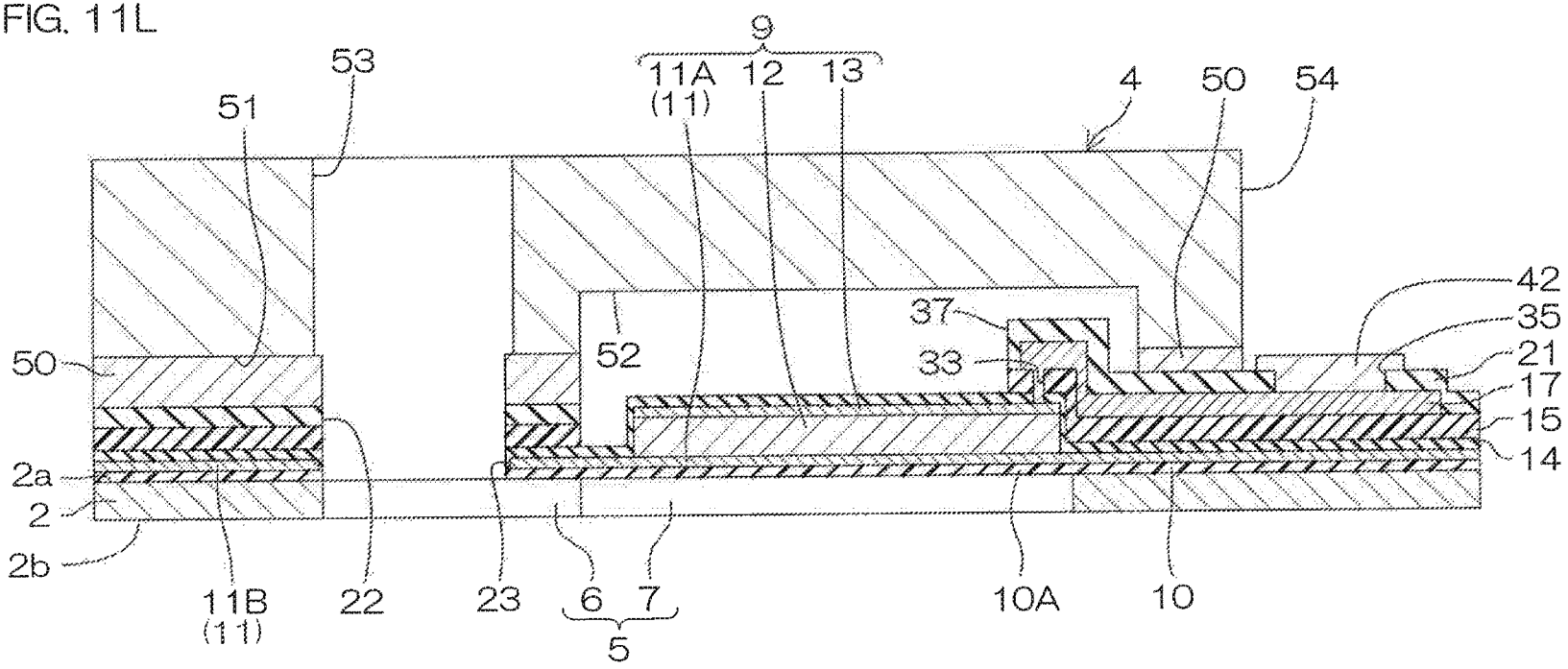
FIG. 11L is a sectional view of a step subsequent to that of FIG. 11K.

Next, as shown in FIG. 11K, an adhesive 50 is coated onto the facing surface 51 of the protective substrate 4 and the protective substrate 4 is fixed onto the actuator substrate 2 so that the ink supply passages 53 and the ink supply penetrating holes 22 are matched. Next, as shown in FIG. 11L, rear surface grinding for thinning the actuator substrate 2 is performed. The actuator substrate 2 is made thin by the actuator substrate 2 being ground from the rear surface 2*b*. For example, the actuator substrate 2 with a thickness of approximately 670 μm in the initial state may be thinned to a thickness of approximately 300 μm. Next, etching (dry etching or wet etching) from the rear surface of the actuator substrate 2 is performed on the actuator substrate 2 to form the ink flow passages 5 (the ink inflow portions 6 and the pressure chambers 7).

In the etching process, the base oxide film formed on the front surface of the movable film formation layer 10 prevents the escaping of metal elements (Pb, Zr, and Ti in the case of PZT) from the piezoelectric film 12 and keeps the piezoelectric characteristics of the piezoelectric film 12 in a satisfactory state. Also as mentioned above, the base oxide film formed on the front surface of the movable film formation layer 10 contributes to maintaining the durability of the silicon layer that forms each movable film 10A.

Figure 11M:
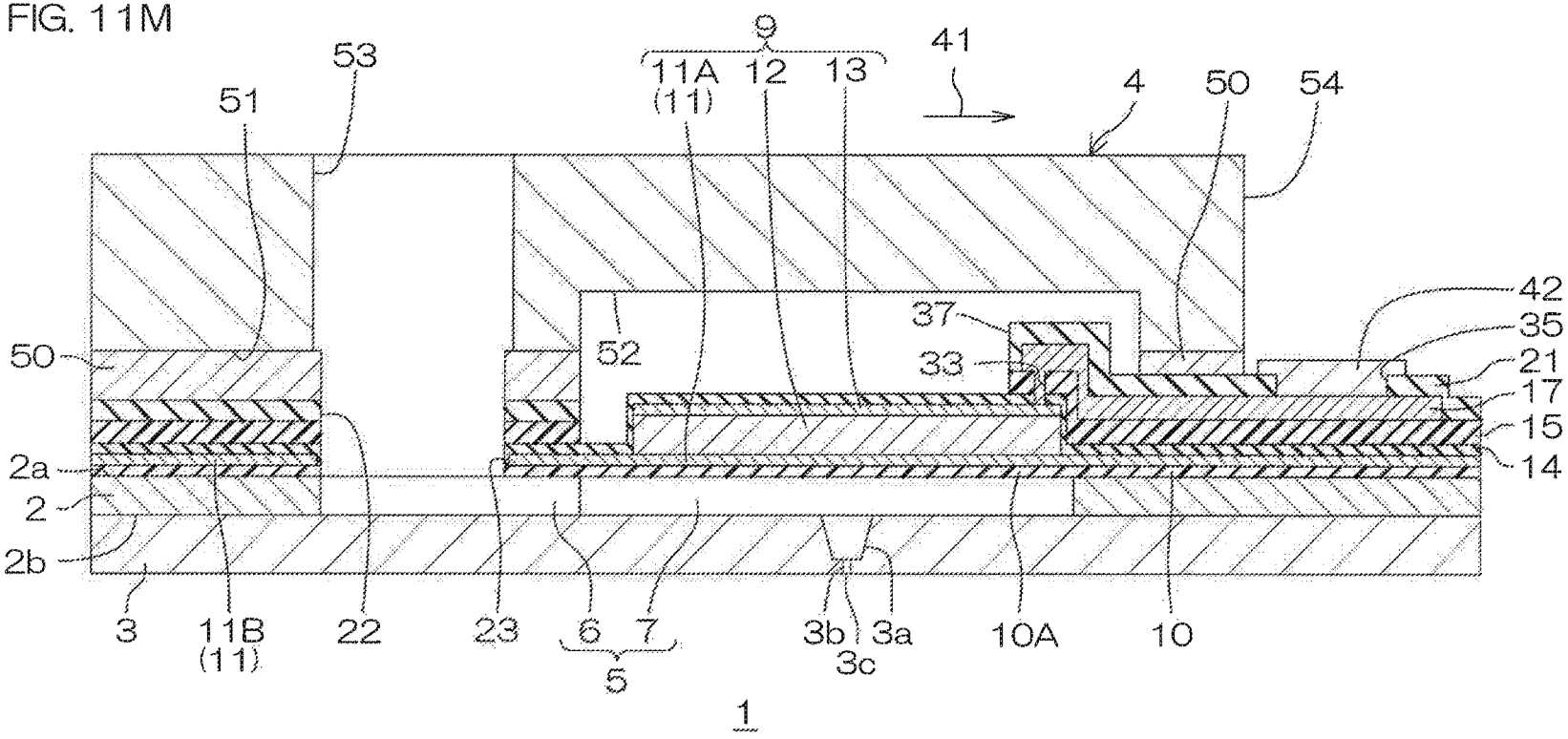
FIG. 11M is a sectional view of a step subsequent to that of FIG. 11L.

Thereafter, as shown in FIG. 11M, the nozzle substrate 3 is adhered onto the rear surface of the actuator substrate 2 and the inkjet printing head 1 is thereby obtained.

Although a preferred embodiment of the present invention has been described above, the present invention may be implemented in yet other preferred embodiments. For example, although with the preferred embodiment described above, a portion of any of the ink supply passages 53 is present in all small regions E, a small region E, in which a portion of any of the ink supply passages 53 is not present, may be included among the plurality of small regions E.

Also, with the preferred embodiment described above, in each small region E in which a portion of an ink supply passage 53 is present, the alignment marks 81 are formed respectively in regions at both sides sandwiching the ink supply passage 53. However, even in a small region E in which a portion of an ink supply passage 53 is present, the alignment marks 81 do not have to be formed respectively in regions at both sides sandwiching the ink supply passage 53.

Also, although with the preferred embodiment described above, two alignment marks 81 are formed in each small region E, one alignment mark 81 may be formed in each small region E or three or more alignment marks 81 may be formed in each small region E.

Also, although in the preferred embodiment described above, the insulating film 15 is formed on a portion of the front surface of the hydrogen barrier film 14, the insulating film 15 may instead be formed on the entirety of the front surface of the hydrogen barrier film 14.

Also, although in the preferred embodiment described above, the insulating film 15 is formed on a portion of the front surface of the hydrogen barrier film 14, the insulating film 15 may be omitted.

Also, although in the preferred embodiment described above, PZT was cited as an example of the material of the piezoelectric film, a piezoelectric material besides this that is constituted of a metal oxide as represented by lead titanate ($PbPO_3$), potassium niobate ($KNbO_3$), lithium niobate ($LiNbO_3$), lithium tantalate ($LiTaO_3$), etc., may be applied instead.

The present application corresponds to Japanese Patent Application No. 2016-146625 filed on Jul. 26, 2016 in the Japan Patent Office, and the entire disclosure of this application is incorporated herein by reference.

While a preferred embodiment of the present invention has been described above, it is to be understood that variations and modifications will be apparent to those skilled in the art without departing the scope and sprit of the present invention. The scope of the present invention, therefore, is to be determined solely by the following claims.

What is claimed is:

1. An inkjet printing head comprising:

an actuator substrate, having an ink flow passage that includes a pressure chamber;

a movable film formation layer, including a movable film, disposed on the pressure chamber and defining a top surface portion of the pressure chamber;

a piezoelectric element, formed on the movable film; and a protective substrate, bonded to the actuator substrate so as to cover the piezoelectric element; and wherein the protective substrate has a housing recess, opening toward the actuator substrate and housing the piezoelectric element, and an ink supply passage in communication with the ink flow passage, and on a surface of the protective substrate at an opposite side from the actuator substrate, an inspection camera positioning alignment mark is formed in each of a plurality of small regions set by dividing an entire region of the surface.

2. The inkjet printing head according to claim 1, wherein the protective substrate has formed therein an electrode pad exposing opening portion that penetrates through the protective substrate in a thickness direction.

3. The inkjet printing head according to claim 2, wherein, in a plan view of viewing from a direction normal to a major surface of the movable film, the top surface portion of the pressure chamber is a rectangle that is long in a predetermined first direction, and the piezoelectric element has a peripheral edge that is receded further toward an interior of the pressure chamber than the movable film.

4. The inkjet printing head according to claim 3, wherein a plurality of the pressure chambers are provided, the piezoelectric element is provided for each pressure chamber, and in the plan view, the actuator substrate has a plurality of pressure chamber columns formed therein at intervals in the first direction, with each pressure chamber column being constituted of a plurality of the pressure chambers provided at intervals in a second direction orthogonal to the first direction.

5. The inkjet printing head according to claim 4, wherein the ink supply passage includes a plurality of elongate rectangular ink supply passages, which, in the plan view, extend in the second direction and are disposed at intervals in the first direction.

6. The inkjet printing head according to claim 5, wherein the small regions include small regions that include a portion of the elongate rectangular ink supply passages, and in at least one of the small regions that include a portion of the elongate rectangular ink supply passages, the alignment mark is formed in each of regions at both sides sandwiching the portion of the elongate rectangular ink supply passages.

7. The inkjet printing head according to claim 1, wherein, in a plan view of viewing from a direction normal to a major surface of the movable film, the top surface portion of the pressure chamber is a rectangle that is long in a predetermined first direction, and the piezoelectric element has a peripheral edge that is receded further toward an interior of the pressure chamber than the movable film.

8. The inkjet printing head according to claim 7, wherein a plurality of the pressure chambers are provided, the piezoelectric element is provided for each pressure chamber, and in the plan view, the actuator substrate has a plurality of pressure chamber columns formed therein at intervals in the first direction, with each pressure chamber column being constituted of a plurality of the pressure chambers provided at intervals in a second direction orthogonal to the first direction.

9. The inkjet printing head according to claim 8, wherein the ink supply passage includes a plurality of elongate rectangular ink supply passages, which, in the plan view, extend in the second direction and are disposed at intervals in the first direction.

10. The inkjet printing head according to claim 9, wherein the small regions include small regions that include a portion of the elongate rectangular ink supply passages, and in at least one of the small regions that include a portion of the elongate rectangular ink supply passages, the alignment mark is formed in each of regions at both sides sandwiching the portion of the elongate rectangular ink supply passages.

11. The inkjet printing head according to claim 10, wherein the electrode pad exposing opening portion includes an opening portion of rectangular shape in plan view, which, in between two predetermined adjacent elongate rectangular ink supply passages among the plurality of elongate rectangular ink supply passages, extends along the elongate rectangular ink supply passages.

12. The inkjet printing head according to claim 9, wherein the electrode pad exposing opening portion includes an opening portion of rectangular shape in plan view, which, in between two predetermined adjacent elongate rectangular ink supply passages among the plurality of elongate rectangular ink supply passages, extends along the elongate rectangular ink supply passages.

13. The inkjet printing head according to claim 1, wherein the piezoelectric element includes a lower electrode, formed on the movable film, a piezoelectric film, formed on the lower electrode, and an upper electrode, formed on the piezoelectric film.

14. The inkjet printing head according to claim 13, further comprising:

a hydrogen barrier film, covering at least entireties of side surfaces of the upper electrode and the piezoelectric film and covering an upper surface of the lower electrode; and an insulating film, formed on the hydrogen barrier film and disposed between the hydrogen barrier film and the upper wiring; and wherein a contact hole, exposing a portion of the upper electrode, is formed in the hydrogen barrier film and the insulating film, and one end portion of the upper wiring is connected to the upper electrode via the contact hole.

15. The inkjet printing head according to claim 14, further comprising: a passivation film, formed on the insulating film and coating the wiring.

16. The inkjet printing head according to claim 1, wherein two of the alignment marks are formed in each small region.

* * * * *